US007963594B2

(12) United States Patent
Wolas

(10) Patent No.: US 7,963,594 B2
(45) **Date of Patent: *Jun. 21, 2011**

(54) CHAIR WITH AIR CONDITIONING DEVICE

(75) Inventor: Scott R. Wolas, Newbury Park, CA (US)

(73) Assignee: Amerigon Incorporated, Northville, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/710,190

(22) Filed: Feb. 22, 2010

(65) Prior Publication Data

US 2010/0146700 A1 Jun. 17, 2010

Related U.S. Application Data

(63) Continuation of application No. 11/933,906, filed on Nov. 1, 2007, now Pat. No. 7,665,803.

(60) Provisional application No. 60/856,052, filed on Nov. 1, 2006.

(51) Int. Cl.
*A47C 7/74* (2006.01)

(52) U.S. Cl. ..... 297/180.13; 297/180.1; 297/180.14

(58) Field of Classification Search ..... 297/180.1, 297/180.13, 180.14

See application file for complete search history.

(56) References Cited

U.S. PATENT DOCUMENTS

| | | | | |
|---|---|---|---|---|
| 1,541,213 | A | | 6/1925 | Harley |
| 2,782,834 | A | | 2/1957 | Vigo |
| 2,826,135 | A | | 3/1958 | Benzick |
| 2,912,832 | A | | 11/1959 | Clark |
| 2,978,972 | A | | 4/1961 | Hake |
| 2,992,604 | A | | 7/1961 | Trotman et al. |
| 3,030,145 | A | | 4/1962 | Kottemann |
| 3,136,577 | A | * | 6/1964 | Richard ..... 297/180.11 |
| 3,137,523 | A | * | 6/1964 | Karner ..... 297/180.13 |
| 3,162,489 | A | | 12/1964 | Trotman |
| 3,209,380 | A | | 10/1965 | Watsky |
| 3,486,177 | A | | 12/1969 | Marshack |
| 3,550,523 | A | | 12/1970 | Segal |
| 3,785,165 | A | | 1/1974 | Valenzuela, Jr. |
| 4,002,108 | A | | 1/1977 | Drori |
| 4,065,936 | A | | 1/1978 | Fenton et al. |

(Continued)

FOREIGN PATENT DOCUMENTS

DE 10238552 8/2001

(Continued)

OTHER PUBLICATIONS

International Search Report for Application No. PCT/2007/83372 mailed Aug. 25, 2008.

(Continued)

*Primary Examiner* — Rodney B White

(74) *Attorney, Agent, or Firm* — Knobbe, Martens, Olson & Bear, LLP

(57) ABSTRACT

A climate controlled seat assembly includes an outer frame and one or more layers of fabric. A panel member attached to the opposite side of the frame defines an inner space located between the panel member and the fabric. One or more channels attached to or formed, in part, by the panel member are in fluid communication with an opening in the panel member and a plurality of orifices located on the channels. Air from a fluid module or other device enters the channels and is discharged through the orifices in the direction of the fabric. The air passes through the fabric and reaches an occupant situated on the seating assembly.

22 Claims, 17 Drawing Sheets

U.S. PATENT DOCUMENTS 4,379,352 A 4/1983 Häuslein et al.
4,413,857 A * 11/1983 Hayashi ..... 297/180.13 X
4,437,702 A 3/1984 Agosta
4,563,387 A 1/1986 Takagi et al.
4,572,430 A 2/1986 Takagi et al.
4,671,567 A * 6/1987 Frobose ..... 297/452.42
4,685,727 A * 8/1987 Cremer et al. ..... 297/180.14
4,777,802 A 10/1988 Feher
4,923,248 A 5/1990 Feher
4,981,324 A 1/1991 Law
5,002,336 A * 3/1991 Feher ..... 297/180.13
5,016,302 A 5/1991 Yu
5,088,790 A 2/1992 Wainwright et al.
5,106,161 A * 4/1992 Meiller ..... 297/452.46
5,117,638 A * 6/1992 Feher ..... 62/3.2
5,172,564 A 12/1992 Reedy
5,226,188 A 7/1993 Liou
5,385,382 A * 1/1995 Single et al. ..... 297/180.13
5,505,520 A 4/1996 Frusti et al.
5,524,439 A 6/1996 Gallup et al.
5,597,200 A * 1/1997 Gregory et al. ..... 297/180.13
5,626,021 A * 5/1997 Karunasiri et al. ..... 62/3.5
5,645,314 A 7/1997 Liou
5,924,766 A * 7/1999 Esaki et al. ..... 297/180.13
5,927,817 A * 7/1999 Ekman et al. ..... 297/452.47
6,003,950 A * 12/1999 Larsson ..... 297/180.13 X
6,019,420 A * 2/2000 Faust et al. ..... 297/180.14
6,059,018 A * 5/2000 Yoshinori et al. .... 297/180.13 X
6,062,641 A * 5/2000 Suzuki et al. ..... 297/180.1
6,085,369 A 7/2000 Feher
6,119,463 A * 9/2000 Bell ..... 62/3.7
6,145,925 A * 11/2000 Eksin et al. ..... 297/180.14
6,179,706 B1 1/2001 Yoshinori et al.
6,186,592 B1 * 2/2001 Orizaris et al. ..... 297/180.13 X
6,189,966 B1 * 2/2001 Faust et al. ..... 297/180.14
6,196,627 B1 * 3/2001 Faust et al. ..... 297/180.14
6,206,465 B1 * 3/2001 Faust et al. ..... 297/180.14
6,223,539 B1 5/2001 Bell
6,291,803 B1 * 9/2001 Fourrey ..... 297/180.12 X
6,474,072 B2 * 11/2002 Needham ..... 62/3.2
6,481,801 B1 11/2002 Schmale
RE38,128 E * 6/2003 Gallup et al. ..... 62/3.5
6,598,251 B2 * 7/2003 Habboub et al. ..... 5/654
6,604,785 B2 * 8/2003 Bargheer et al. ..... 297/180.14
6,606,866 B2 * 8/2003 Bell ..... 62/3.7
6,619,736 B2 * 9/2003 Stowe et al. ..... 297/180.14
6,619,737 B2 9/2003 Kunkel et al.
6,626,488 B2 * 9/2003 Pfahler ..... 297/180.14 X
6,644,735 B2 * 11/2003 Bargheer et al. ..... 297/180.13
6,676,207 B2 * 1/2004 Rauh et al. ..... 297/180.14
6,685,553 B2 2/2004 Aoki
6,695,402 B2 2/2004 Sloan, Jr.
6,700,052 B2 * 3/2004 Bell ..... 136/201
6,739,655 B1 5/2004 Schwochert et al.
6,761,399 B2 * 7/2004 Bargheer et al. ..... 297/180.14 X
6,774,346 B2 8/2004 Clothier
6,786,541 B2 * 9/2004 Haupt et al. ..... 297/180.1
6,786,545 B2 * 9/2004 Bargheer et al. ..... 297/217.1
6,808,230 B2 * 10/2004 Buss et al. ..... 297/180.14 X
6,828,528 B2 * 12/2004 Stowe et al. ..... 219/483
6,857,697 B2 * 2/2005 Brennan et al. ..... 297/180.13
6,893,086 B2 * 5/2005 Bajic et al. ..... 297/180.14
6,976,734 B2 * 12/2005 Stoewe ..... 297/180.14
7,040,710 B2 5/2006 White et al.
7,070,232 B2 * 7/2006 Minegishi et al. ..... 297/180.14
7,108,319 B2 * 9/2006 Hartwich et al. ..... 297/180.1
7,114,771 B2 * 10/2006 Lofy et al. ..... 297/180.13
7,201,441 B2 * 4/2007 Stoewe et al. ..... 297/180.14
7,213,876 B2 5/2007 Stoewe
7,261,372 B2 8/2007 Aoki
7,338,117 B2 3/2008 Igbal et al.
7,475,464 B2 * 1/2009 Lofy et al. ..... 297/180.13 X
7,587,901 B2 9/2009 Petrovski
7,607,739 B2 10/2009 Browne et al.
7,665,803 B2 * 2/2010 Wolas ..... 297/180.13
7,708,338 B2 5/2010 Wolas
RE41,765 E 9/2010 Gregory et al.
7,827,805 B2 11/2010 Comiskey et al.
2004/0090093 A1 * 5/2004 Kamiya et al. ..... 297/180.14
2004/0195870 A1 10/2004 Bohlender et al.
2005/0285438 A1 * 12/2005 Ishima et al. ..... 297/452.42
2006/0087160 A1 4/2006 Dong et al.
2006/0197363 A1 * 9/2006 Lofy et al. ..... 297/180.13
2006/0214480 A1 * 9/2006 Terech ..... 297/180.13
2006/0284455 A1 * 12/2006 Terech ..... 297/180.14
2007/0001489 A1 * 1/2007 Terech ..... 297/180.1
2007/0040421 A1 * 2/2007 Zuzga et al. ..... 297/180.13
2007/0200398 A1 8/2007 Wolas et al.
2007/0262621 A1 11/2007 Dong et al.
2007/0277313 A1 12/2007 Terech
2008/0148481 A1 6/2008 Brykalski et al.
2009/0033130 A1 2/2009 Marquette et al.
2009/0218855 A1 9/2009 Wolas
2010/0011502 A1 1/2010 Brykalski et al.

FOREIGN PATENT DOCUMENTS

DE 10115242 10/2002
DE 20120516 6/2003
EP 0 411 375 2/1991
JP 53-80603 7/1978
JP 54-097212 7/1979
JP 58-185952 10/1983
JP 60-12095 1/1985
JP 61-194354 12/1986
JP 62-107762 7/1987
JP 62-191212 8/1987
JP 63-178548 11/1988
JP 64-30042 2/1989
JP 1-172012 7/1989
JP 4-107656 9/1992
JP 5-623 1/1993
JP 5-23235 2/1993
JP 5-10700 3/1993
JP 5-213056 8/1993
JP 05-277020 10/1993
WO WO 02/11968 2/2002
WO WO 02/053400 7/2002
WO WO 03/051666 6/2003

OTHER PUBLICATIONS

Feher, Steve, Thermoelectric Air Conditioned Variable Temperature Seat (VTS) & Effect Upon Vehicle Occupant Comfort, Vehicle Energy Efficiency, and Vehicle Environment Compatibility, SAE Technical Paper, Apr. 1993, pp. 341-349.

Lofy, J. et al., Thermoelectrics for Environmental Control in Automobiles, Proceeding of Twenty-First International Conference on Thermoelectrics (ICT 2002), published 2002, pp. 471-476.

4 photographs of a climate controlled seat assembly and an accompanying Statement of Relevance.

* cited by examiner

CHAIR WITH AIR CONDITIONING DEVICE

CROSS-REFERENCE TO RELATED APPLICATIONS

This application is a continuation of U.S. patent application Ser. No. 11/933,906, filed Nov. 1, 2007, now U.S. Pat. No. 7,665,803, which claims the priority benefit under 35 U.S.C. §119(e) of U.S. Provisional Application No. 60/856,052, filed Nov. 1, 2006, the entireties of both of which are hereby incorporated by reference herein.

BACKGROUND

1. Field of the Invention

This application relates to climate control, and more specifically, to climate control of a seat assembly.

2. Description of the Related Art

Temperature modified air for environmental control of living or working space is typically provided to relatively extensive areas, such as entire buildings, selected offices, or suites of rooms within a building. In the case of enclosed areas, such as homes, offices, libraries and the like, the interior space is typically cooled or heated as a unit. There are many situations, however, in which more selective or restrictive air temperature modification is desirable. For example, it is often desirable to provide an individualized climate control for a seat assembly so that substantially instantaneous heating or cooling can be achieved. For example, a chair situated within a hot, poorly-ventilated environment can be uncomfortable to the occupant, especially if the occupant intends to use the chair for extended time periods. Furthermore, even with normal air-conditioning, on a hot day, the seat occupant's back and other pressure points may remain sweaty while seated. In the winter time, it is highly desirable to have the ability to quickly warm the seat of the occupant to facilitate the occupant's comfort, especially where heating units are unlikely to warm the indoor space as quickly. Therefore, a need exists to provide a climate-controlled seat assembly for use in various indoor and/or outdoor environments.

SUMMARY

According to some embodiments of the present application, a climate controlled seat assembly comprises an outer frame, at least one layer of a fabric at least partially spanning across a portion of the outer frame and a panel member comprising a first surface and a second surface, the first surface of the panel member generally positioned along the outer frame. The panel member includes a substantially air tight seal with the outer frame, the panel member and the fabric defining an interior space, at least one opening extending from the first surface to the second surface of the panel member and at least one channel positioned on the first surface of the panel member, the channel defining a passageway, the passageway being in fluid communication with the opening and comprising a plurality of orifices in communication with the interior space. In some embodiments, the climate controlled chair is an office chair, a medical chair (e.g., chemotherapy chair, dentist chair, wheelchair, etc.), a bed or any other type of assembly capable of receiving an occupant.

In one arrangement, a climate controlled seat assembly includes an outer frame, one or more fabric layers that span at least partially across the outer frame and a panel member positioned along the outer frame. The panel member forms a substantially air tight seal with the outer frame and encloses an inner space between the panel member and the fabric. In addition, the panel member includes at least one opening extending from the first side to the second side of the panel member. One or more channels positioned along the side of the panel member define a passageway, which is in fluid communication with the panel member opening and a plurality of orifices positioned along the channels. The seat assembly can be configured such that a volume of a fluid directed through the panel member opening enters the passageway, is at least partially discharged into the inner space through the plurality of orifices and primarily escapes the inner space through the fabric. In another embodiment, the passageway is defined by the space between the channel and a side of the panel member. In other arrangement, the channel and the panel member are a unitary piece.

In some arrangements, the climate controlled seat further includes a fluid module that is in fluid communication with the passageway. In another arrangement, the fluid module is positioned along a side of the panel member. In other embodiments, the fluid module includes a thermoelectric device. In yet another embodiment, the fabric includes a mesh structure manufactured, at least in part, of a polymer material. In still other arrangements, the panel member is manufactured from a plastic material. In some embodiments, the frame comprises a metallic material. In other embodiments, the frame comprises a carbon graphite material. In one arrangement, the outer frame defines a backrest portion and/or a bottom seat portion.

In one arrangement, a climate controlled seat assembly includes a frame member with an at least one opening and a cushion member having a first surface, a second surface and a central body extending between the first and second surfaces, with at least a portion of the central body configured to be generally air permeable. In addition, the seat assembly includes one or more channels positioned adjacent to the frame member, the channels and frame member defining a passageway that is in fluid communication with the opening. In some embodiments, the channels additionally include a plurality of orifices. In certain arrangements, the seat assembly is configured such that a volume of a fluid directed through the frame member opening enters the passageway, is at least partially discharged toward the second surface of the cushion member and at least partially diffuses through the central body of the cushion member toward the first surface of the cushion member.

In other arrangement, the channel is formed directly into a surface of the cushion member. In some arrangements, the seat assembly further includes a fluid module that is in fluid communication with the passageway. In certain arrangements, the fluid module is positioned along a side of the frame member. In other arrangements, the fluid module includes a thermoelectric device. In some embodiments, the seat assembly further comprises a covering material attached to an outer surface of at least a portion of the cushion member. In yet other arrangements, the covering material comprises a fabric material. In still other arrangements, the cushion member comprises, at least in part, a foam material. In one embodiment, the cushion member defines a backrest portion and/or a bottom seat portion. In another embodiment, the climate controlled seat assembly additionally includes at least one heating member positioned on or within the cushion member.

In other arrangements, a climate controlled seat assembly includes an outer frame, one or more layers of a fabric that span, at least partially, the outer frame and a support member at least partially spanning the outer frame and positioned along or adjacent a surface of the fabric. In certain arrangements, the support member includes a first external side, a second external side and an intermediate external side generally positioned between the first and second external sides. In addition, the support member comprises at least one internal passageway, an opening on the second external side of the support member that is in fluid communication with the internal passageway and a plurality of orifices along the first external side of the support member. In one embodiment, the orifices are in fluid communication with the internal passageway. The support member is configured such that a volume directed through the opening is routed within the passageway and is discharged through the orifices in the general direction of the fabric.

In other arrangements, the support member is configured to provide lumbar support to an occupant sitting in the seating assembly. In yet other arrangements, the vertical position of the support member is adjustable. In still another embodiment, the seat assembly further includes a fluid module that is in fluid communication with the passageway.

In one embodiment, the fluid module is positioned along the second external side of the support member. In some embodiments, the fluid module includes a thermoelectric device. In yet other embodiments, the climate controlled seat additionally comprises one or more orifices positioned along the intermediate external side of the support member and in fluid communication with the passageway. In one arrangement, the outer frame defines a backrest portion. In other embodiments, the fabric comprises a mesh structure manufactured, at least in part, of a polymer material.

BRIEF DESCRIPTION OF THE DRAWINGS

These and other features, aspects and advantages of the present inventions are described with reference to drawings of certain preferred embodiments, which are intended to illustrate, but not to limit, the inventions. The drawings include twenty-seven (27) figures. It is to be understood that the attached drawings are for the purpose of illustrating concepts of the present inventions and may not be to scale.

DETAILED DESCRIPTION OF THE PREFERRED EMBODIMENTS

The discussion below and the figures referenced therein describe various embodiments of a climate controlled seat assembly. A number of these embodiments are particularly well suited to serve as ergonomic office chairs. However, it will be appreciated that the climate control features described herein may be incorporated into other types of seat assemblies, including recliner chairs, medical chairs, chemotherapy chairs, dentist chairs, wheelchairs, other chairs where occupants are seated for extended time periods, sofas, beds, automobile seats, airplane seats, stadium seats, benches, wheelchairs, outdoor furniture and the like. Regardless of their exact configuration, the seat assemblies can be sized, shaped, manufactured and otherwise designed and configured to accommodate occupants of various size, shape and weight. In some embodiments, the climate control features described herein can be incorporated into other types of support structures and/or components thereof (e.g., beds, armrests, neck or foot supports, etc.).

A climate controlled seat assembly can help increase the overall comfort level for the occupant, especially if the occupant tends to be situated within the seat assembly for extended time periods (e.g., medical chairs such as chemotherapy or dentist chairs, hospital beds, office chairs, etc.). By regulating the flowrate and/or the temperature of fluid delivered to or near the interface between the seat assembly and the occupant, the climate control features described below can help reduce perspiration, avoid skin irritation and discomfort, improve the general comfort level of the occupant and the like. In addition, such seat assemblies can provide other benefits, such as, for example, energy savings, as the importance of regulating the temperature of an entire room or some other enclosed space is diminished. Thus, the seat assembly can provide localized temperature control even when the surrounding ambient temperature is outside of a desirable range.

Office Chair without Cushions

Figure 1:
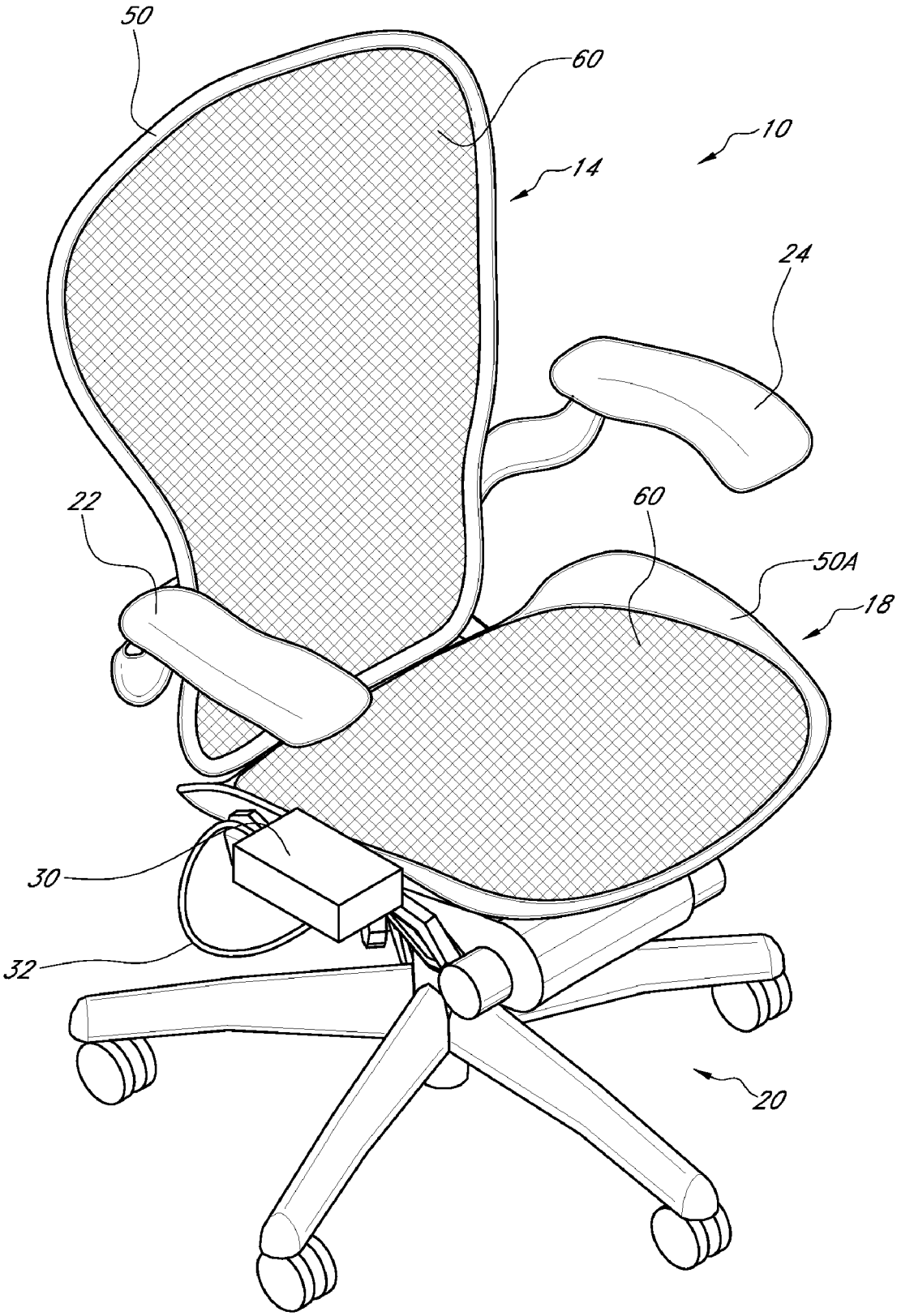
FIG. 1 is a perspective view of a seating assembly that includes a climate control system configured in accordance with one embodiment.
Figure 2:
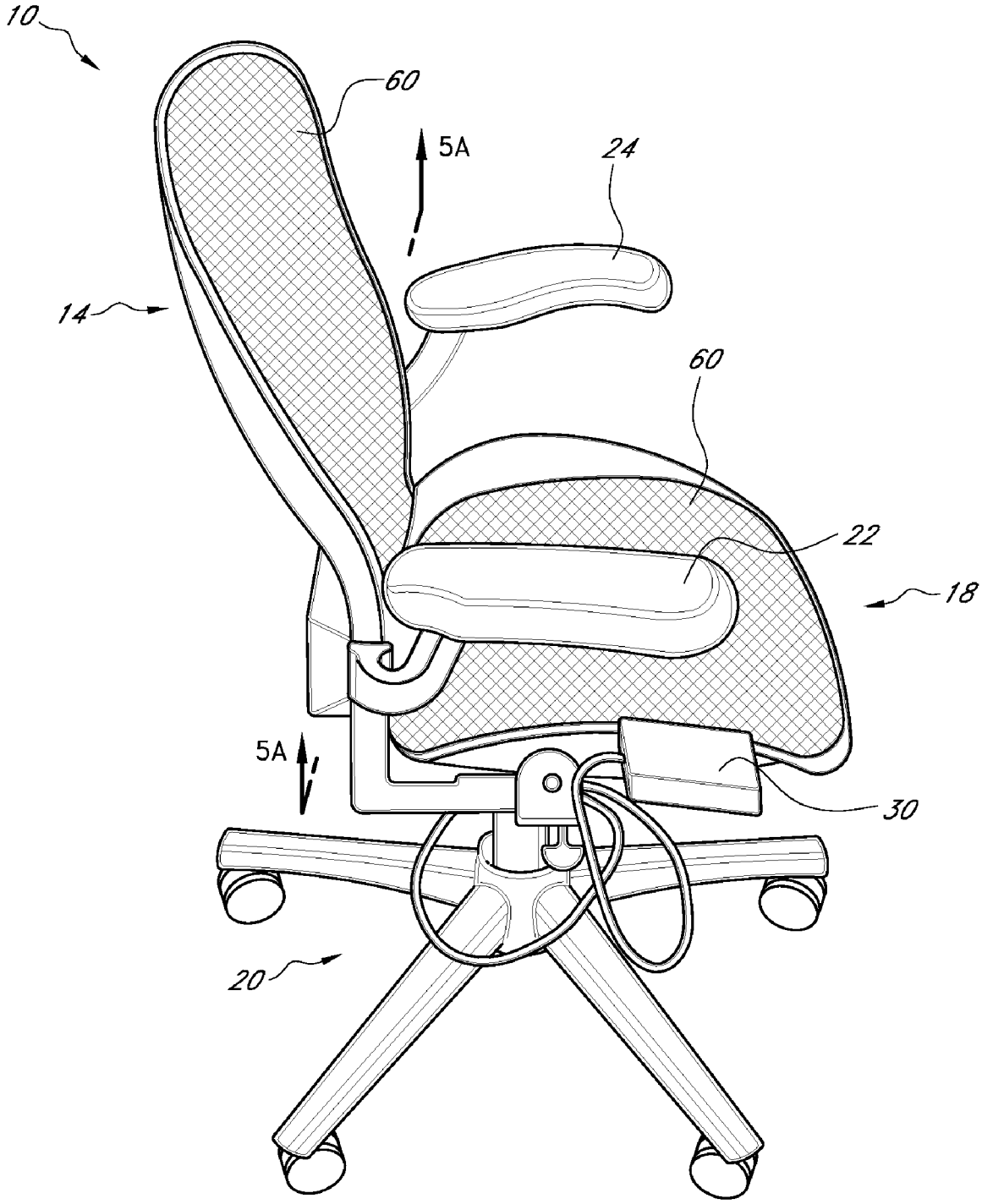
FIG. 2 is a side perspective view of the seating assembly of FIG. 1.

As illustrated in the embodiments of FIGS. 1 and 2, a seat assembly 10 can comprise a backrest portion 14 and a bottom seat portion 18. The seat assembly 10 can also include a bottom base 20, which in the depicted embodiment, enables an occupant to easily move the chair assembly 10 relative to a floor or another bottom surface through the use of one or more bottom wheel assemblies. In addition, the seat assembly may be configured to swivel or rotate about a central axis. The seat assembly 10 can also include one or more other features, such as, for example, armrests 22, 24, to further enhance the appearance and/or functionality of the seat assembly 10. In some embodiments, the seat assembly 10 includes one or more adjustment controls (e.g., knobs, levers) that permit the position, tension and other characteristics of the various seating assembly components (e.g., backrest portion, bottom seat portion, armrests, etc.) to be adjusted, as desired or required by a particular user or application.

In some embodiments, the seat assembly 10 includes one or more climate control systems, the operational settings of which can be controlled using a control unit 30. The control unit 30 can be situated so that it is easily accessible to an occupant while he or she is positioned within or near the seat assembly 10. For example, in FIGS. 1 and 2, the control unit 30 is positioned underneath an armrest 22, next to the bottom seat portion 18. However, in other embodiments, the control unit 30 can be positioned in one or more other locations than illustrated herein. The control unit 30 can be equipped with an extension cord 32, making it easier for an occupant to handle or manipulate the control unit 30 during use. In other embodiments, the control unit 30 is positioned at any other location or may be configured to remotely communicate with the climate control system of the chair assembly. The climate control system and the control unit are described in more detail below.

With continued reference to FIGS. 1 and 2, when positioned on the seat assembly 10, an occupant may contact both a backrest portion 14 and a bottom seat portion 18. Thus, in some embodiments, the backrest portion 14 and the bottom seat portion 18 cooperate to support the occupant generally in a sitting position. However, in other embodiments where the backrest portion 14 can be tilted relative to the bottom seat portion 18, the seat assembly 10 may be configured to support an occupant in a different position (e.g., reclined, horizontal, substantially horizontal, etc.).

Figure 3:
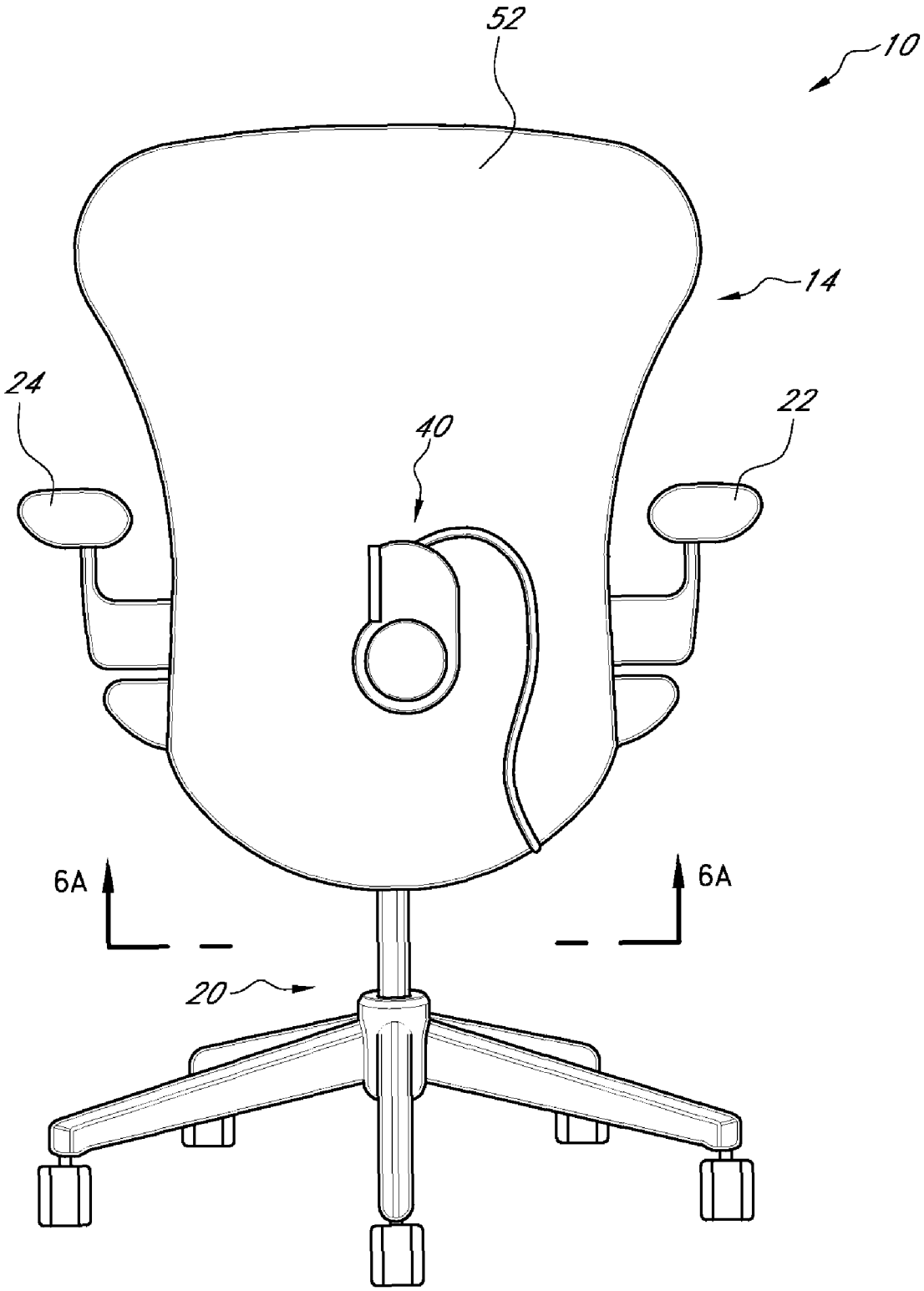
FIG. 3 is a rear view of the seating assembly of FIG. 1.
Figure 6B:
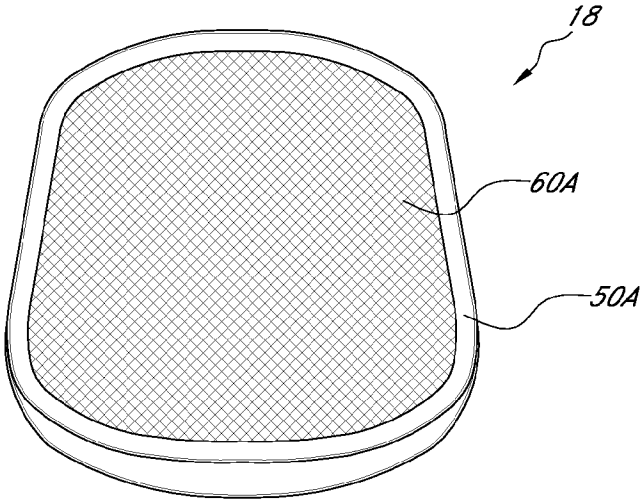
FIG. 6B illustrates the bottom seat portion of FIG. 6A with a bottom panel removed.
Figure 6A:
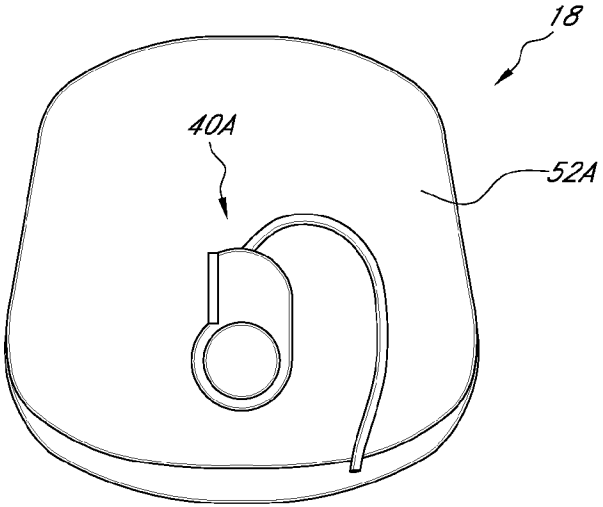
FIG. 6A is a bottom view of one embodiment of a bottom seat portion of a climate-controlled seating assembly.

FIG. 3 illustrates a rear view of the seat assembly of FIGS. 1 and 2. In the depicted embodiment, the backrest portion 14 includes a rear panel 52 to which is attached a fluid module 40. Although the illustrated backrest portion 14 includes only a single fluid module 40, it will be appreciated that additional fluid modules can be provided in order to deliver the desired or required fluid volume to the seat assembly. In addition, as illustrated in FIG. 6A and discussed in greater detail herein, fluid modules can also be provided to the bottom seat portion 18 and/or any other component or portion of a climate controlled seat assembly 10.

As discussed in greater detail herein, fluid modules can be configured to provide temperature conditioned and/or unconditioned air or other fluid (and/or to remove air or fluid) to one or more distribution systems positioned within or adjacent to one or more seat assembly components. In this manner, fluid modules can help provide a fluid flow to warm and/or cool an outer surface of the seating assembly that interfaces with an occupant. Alternatively, the fluid modules can deliver ambient air to and/or or from areas near a seating assembly, without providing any temperature conditioning at all. The fluid modules can include heating and/or cooling elements (e.g., Peltier or other thermoelectric devices, etc.) that are configured to alter the temperature of a fluid being delivered to the seat assembly. In addition, a fluid module can include a fluid transfer component (e.g., an axial or radial fan) in order to transfer the air or other fluid to and/or from the seat assembly and/or move the air or other fluid through or past the heating and/or cooling elements. However, in other embodiments, the fluid modules can be configured to provide unconditioned air (e.g., ambient air) to the front surface of the backrest portion 14, bottom seat portion 18 and/or any other part of the seat assembly 10. In such embodiments, the fluid modules may include only a fluid transfer device (e.g., an axial or radial fan) to facilitate movement of the air or other fluid during to and/or from a seat assembly. Accordingly, as used herein, "fluid module" is a broad term and may be used to describe any device capable of transferring a fluid and/or selectively temperature conditioning a fluid.

Figure 4A:
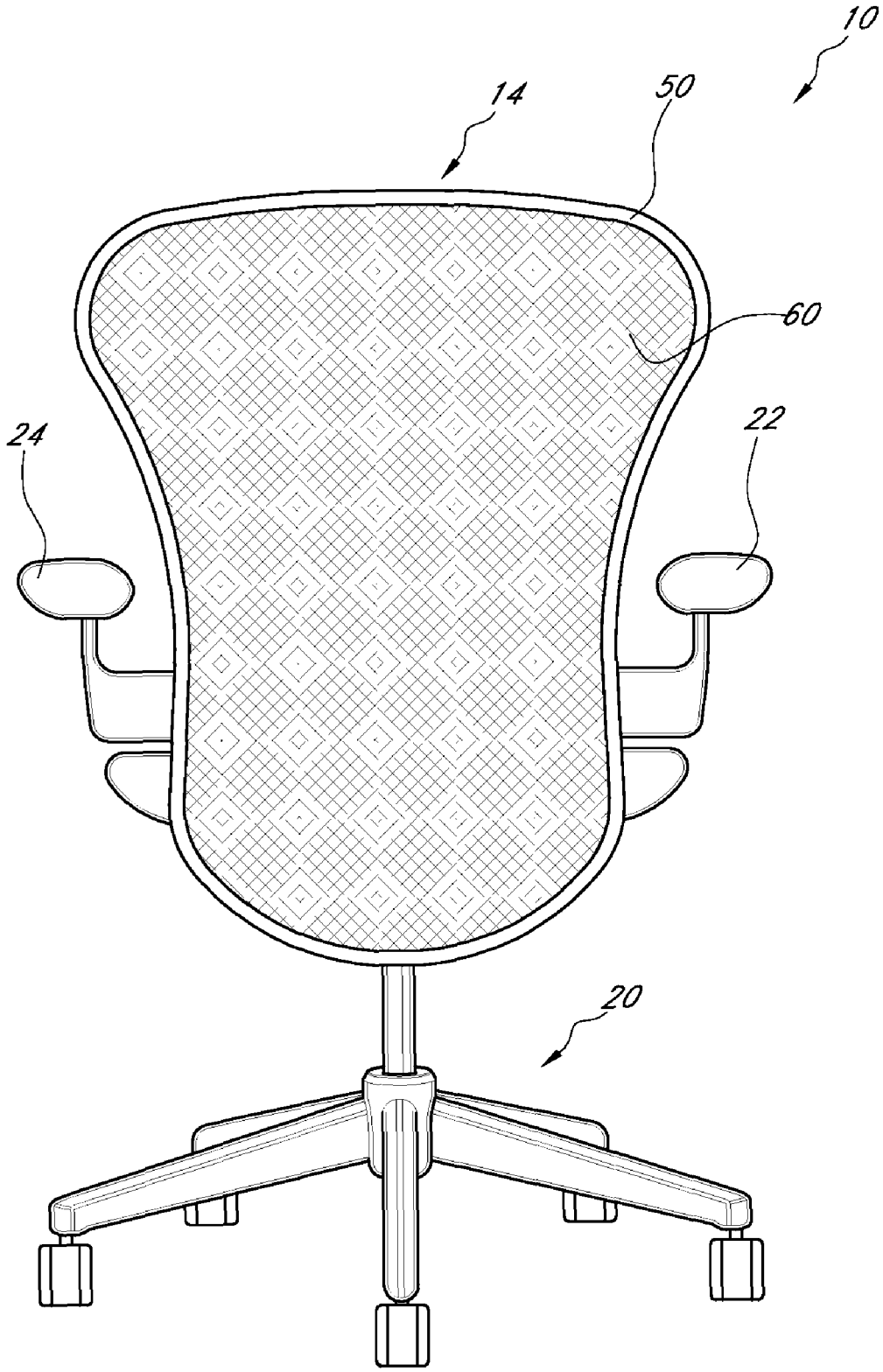
FIG. 4A is a seating assembly such as the one illustrated in FIG. 3 with a rear panel removed from the backrest portion according to one embodiment.

FIG. 4A illustrates a rear view of the seat assembly 10 of FIG. 3 with a rear panel 52 removed from the backrest portion 14 to illustrate a mesh fabric 60 that generally extends across a frame structure 50. In some embodiments, the frame member 50 comprises one or more strong and durable rigid or semi-rigid materials that are capable of maintaining the shape and structural integrity of the frame member 50. For example, the frame member can comprise metal (e.g., steel, aluminum, etc.), graphite or other composites, plastic and/or the like. The mesh fabric 60 can be constructed of plastic, other polymeric material and/or the like. In addition, the mesh fabric 60 can comprise one or more layers, as desired or required by a particular application or use. In some embodiments, the mesh fabric 60 is a flexible, open weave material that is configured to permit air and other fluids to pass through it. The mesh fabric 60 (the opposite side of which is illustrated in FIGS. 1 and 2), the frame member 50, the connection between the fabric 60 and the frame member 50 and/or one or more other seat assembly features and components can be advantageously configured to adequately and safely support the weight of a seat assembly occupant. Accordingly, the climate controlled seat assembly 10 may not require any cushioned portions or other similar components.

Figure 4B:
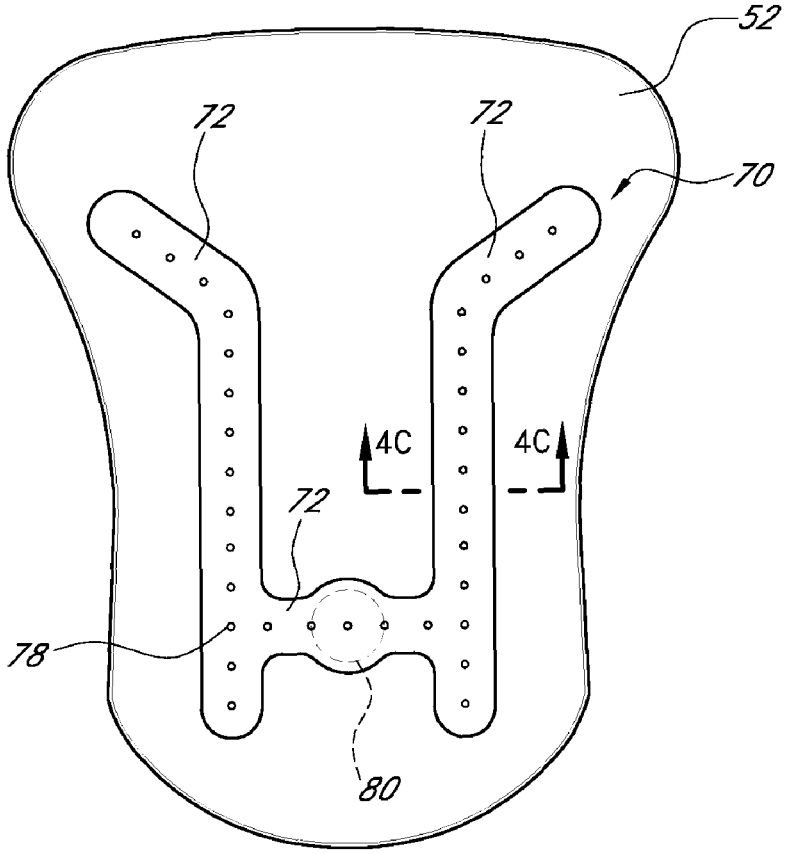
FIG. 4B is the rear panel of FIG. 3 comprising a fluid distribution system along its interior surface according to one embodiment.

With reference to FIG. 4B, the rear panel 52 of the seat assembly 10 can include a fluid distribution system 70, which, in some embodiments, may comprise one or more distribution channels 72 that are in fluid communication with one another. In the arrangement shown in FIG. 4B, the distribution system 70 includes two main channels that extend generally vertically along a substantial distance of the rear panel 52. These two channels (or more or fewer channels, based on the particular configuration) can be placed in fluid communication with one another using one or more horizontally-oriented channels. Of course, it will be appreciated that the shape, size, orientation, general configuration and/or other details of the distribution system 70 can be different than illustrated in FIG. 4B and described herein.

Figure 4C:
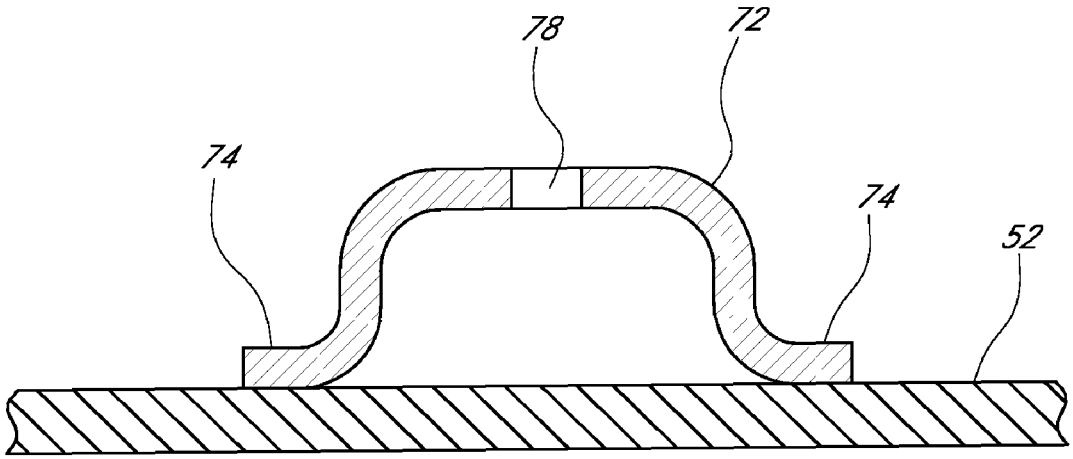
FIG. 4C is a cross sectional view of the fluid distribution system illustrated in FIG. 4B.

FIG. 4C illustrates a cross sectional view of the distribution channel 72 depicted in FIG. 4B. In the illustrated embodiment, the channel 72 comprises a generally semi-circular shape having flanges 74 that extend from each of its sides. It will be appreciated that the shape, size and other details of the distribution channels 72 can be different than illustrated and disclosed herein.

With continued reference to FIG. 4C, the flanges 74 of the distribution channels can be configured to provide a contact surface with the adjacent panel 52 to facilitate the attachment of the distribution system 70 to the panel 52. In some arrangements, the distribution system 70 can be glued, taped, bolted, riveted, snap fit or otherwise joined to the rear panel 52. In other embodiments, the distribution system 70 can be molded directly into the rear panel 52, thereby eliminating the need to separately attach a distribution system 70 to the panel 52.

Regardless of its shape, size, method of attachment to the rear panel 52, general configuration and/or its other characteristics or properties, the distribution system 70 can be configured to receive a fluid (e.g., air) from a fluid module, whether conditioned or unconditioned (e.g., ambient), and deliver it to a plurality of orifices 78 distributed along one or more surfaces or other portions of the distribution channels 72. The inlet point at which air from the fluid module enters the distribution system 70 can be positioned to coincide with an opening 80 in the rear panel 52. Thus, if fluid module is mounted over the opening 80 on the opposite side of the rear panel 52, it will be in fluid communication with the distribution system 70. It will be appreciated that the number, size, spacing, quantity, location and/or other details of the orifices 78 can be different than discussed and/or illustrated herein, as desired by a user or as required by a particular application or use.

Figure 5A:
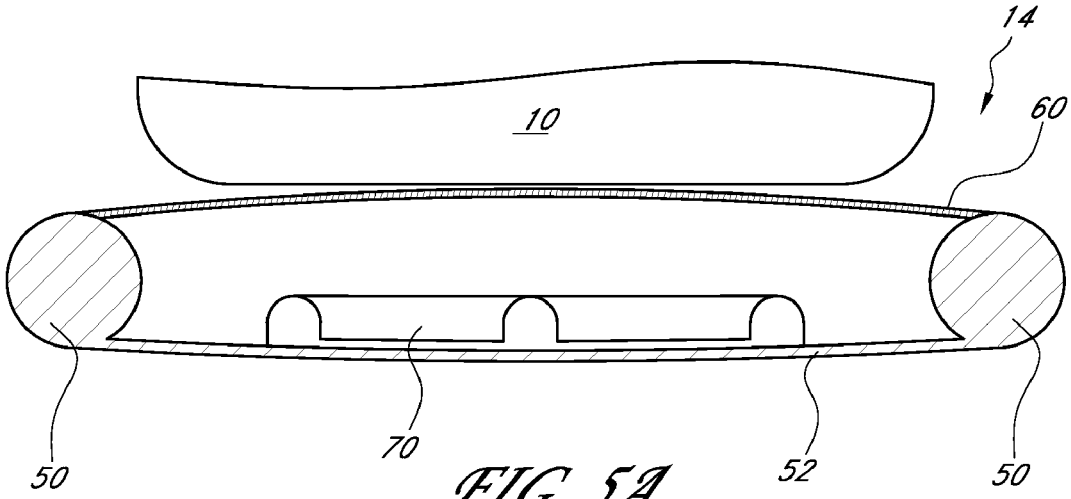
FIG. 5A is a cross-sectional view of the backrest portion of the seating assembly as illustrated in FIGS. 1-3 according to one embodiment.

FIG. 5A illustrates a cross sectional view of the backrest portion 14 of a seating assembly taken along a plane as indicated in FIG. 2. As discussed, one or more sections of mesh fabric 60 can be configured to generally span across and be secured to opposite members of a frame structure 50. In addition, a rear panel 52, which can include a distribution system 70 along one or more interior surfaces, can also be attached to the frame structure 50 of the backrest portion 14. Thus, as illustrated in FIG. 5A, a space or gap can be formed between the mesh fabric 60 and the adjacent surface of the distribution system 70. Consequently, air or other fluid directed into the distribution system 70 can be ultimately delivered to the mesh fabric 60 via this space or gap.

Figure 5B:
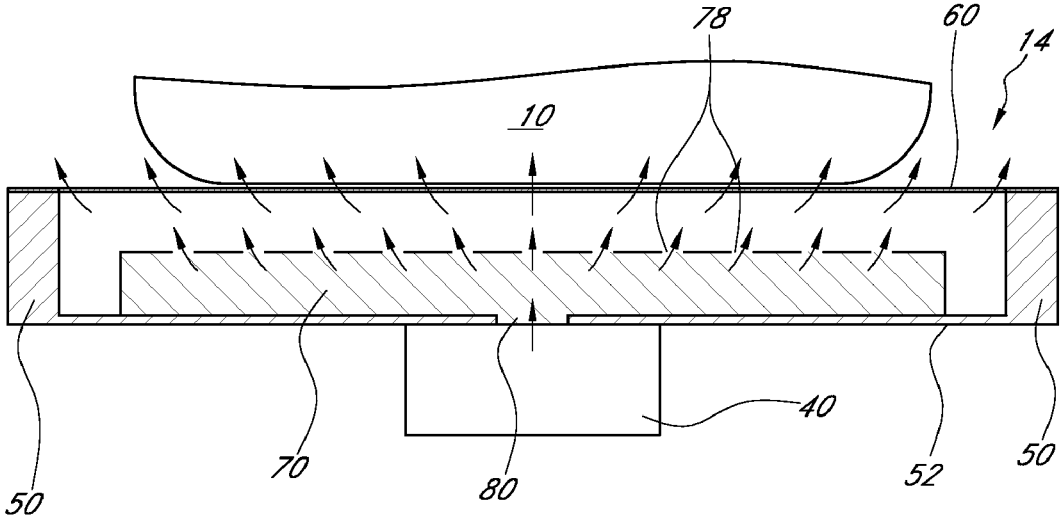
FIG. 5B is a schematic illustration of air flowing through a backrest portion of a seating assembly according to one embodiment.

FIG. 5B schematically illustrates one embodiment of an airflow pattern from a fluid module 40A to the backrest portion 14. As shown, the fluid module 40A can be generally positioned over the opening 80 of the rear panel 52, and can be in fluid communication with the distribution system 70. In some embodiments, the fluid distribution system 70 is located on the opposite side of the rear panel 52. Air or other fluid from the fluid module 40 can then be routed to the distribution system 70 and ultimately discharged through a plurality of orifices 78 positioned on the distribution channels. Air exiting the channel orifices 78 can enter the space generally defined between the distribution system 70 and the mesh fabric 60. In some embodiments, the mesh fabric 60 is configured to permit air to diffuse through it, thereby delivering the air to the other side of the mesh fabric where an occupant O is situated.

It will be appreciated that the seating assembly 10 can include a similar climate control system along its bottom seat portion 18, either in lieu of or in addition to a climate control on its seat back portion. FIG. 6A illustrates a bottom view of the bottom seat portion 18 according to one embodiment. As depicted, the bottom seat portion 18 includes a bottom panel 52A that effectively spans the entire area of the bottom seat portion 18. In other embodiments, however, the bottom panel 52A can span only a fraction of the area of the bottom seat portion 18. As with the backrest portion 14, a fluid module 40A can be attached to the bottom panel 52A. FIG. 6B illustrates a bottom view of the bottom seat portion 18 of FIG. 6A with the bottom panel 52A removed to illustrate the mesh fabric 60A that generally spans across the outer frame 50A.

It will be appreciated that for the various embodiments illustrated and described herein, one or more other types of air permeable materials can be used in lieu of a mesh fabric. For example, air or other fluid can be delivered through one or more layers of open cell foam and/or some other porous structure. Further, in some embodiments, the seating assembly can include one or more air impermeable layers. Such impermeable layers can be included to prevent the delivery or withdrawal of air or other fluid from certain portions of the seating assembly. Alternatively, one or more portions of such air impermeable layers can include a plurality of openings through which air or other fluid can pass. Thus, a seating assembly can include additional or different layers to enhance or otherwise modify the comfort or other characteristics of a climate controlled seating assembly.

Figure 6C:
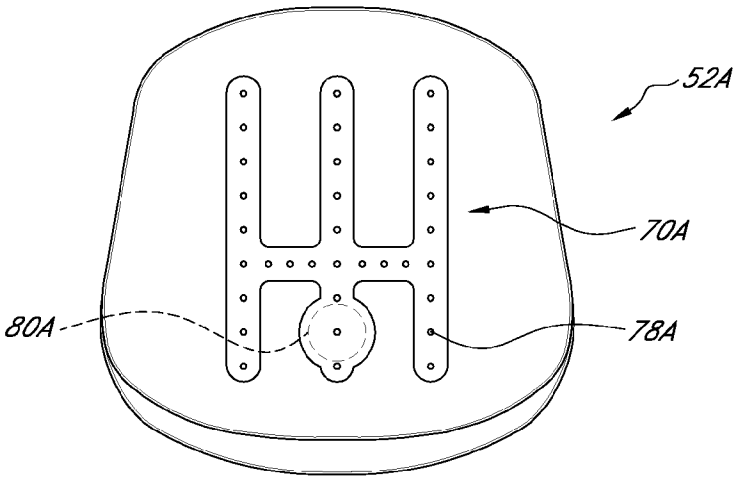
FIG. 6C illustrates a bottom panel of FIG. 6B comprising a fluid distribution system along its interior surface according to one embodiment.

Further, as shown in FIG. 6C, the bottom panel 52A can include a fluid distribution system 70A that is in fluid communication with the fluid module 40A through a corresponding opening 80A in the bottom panel. The distribution system 70A can be configured to function substantially similarly to the various embodiments of the distribution system 70 of the backrest portion 14 described herein. Thus, in the illustrated arrangement, air or other fluid from the fluid module 40A can be distributed through the plurality of orifices 78A of the distribution channels to targeted areas of the bottom seat portion 18. As described with reference to the backrest portion 14, air can exit the distribution system 70A and enters the space enclosed between the distribution system 70B and the mesh fabric 60A. Eventually, the air may pass through the one or more layers of mesh fabric 60A of the bottom seat portion 18 to reach the occupant.

Office Chair with Cushions

Figure 7:
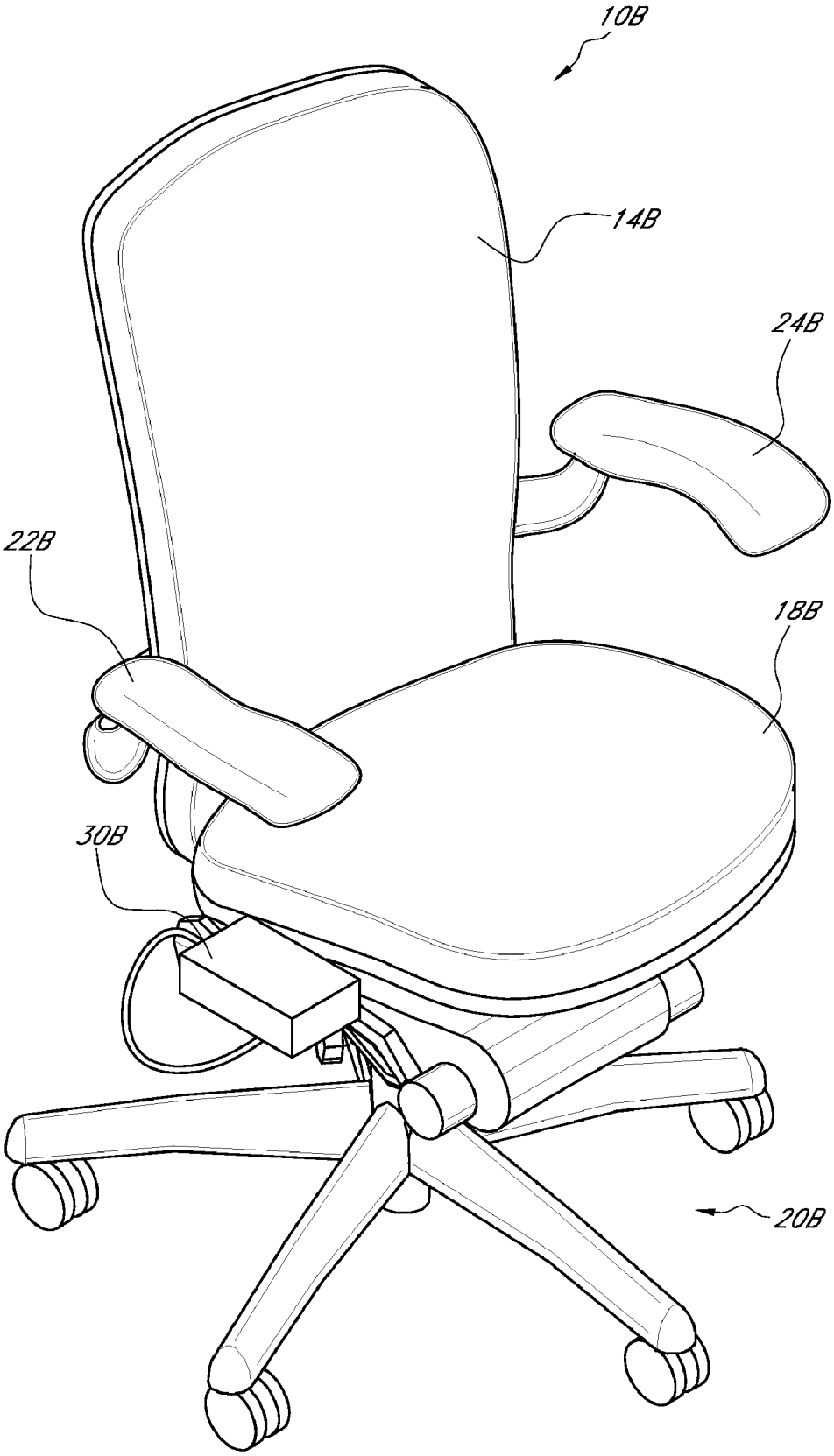
FIG. 7 is a perspective view of a climate controlled seating assembly according to another embodiment.

In other embodiments, the backrest and/or bottom seat portions of the seat assembly include one or more cushions. For example, FIG. 7 illustrates a climate controlled seat assembly 10B comprising a backrest portion 14B and a bottom seat portion 18B that include cushions. The cushions can be supported on a frame or other support member that preferably provides the seat assembly 10B with the necessary structural strength, integrity and durability. The cushions, which can provide a comfortable seating interface for the occupant, can be constructed of one or more materials, such as foam, other synthetic and natural materials and/or the like.

As is discussed in greater detail herein, the cushions can be configured to be substantially air permeable (e.g., comprise air permeable materials, comprise openings, etc.) to permit air or other fluids to diffuse through the corresponding backrest and/or bottom seat portion. The air permeability can result from the type of material used and/or the structural composition of the cushion. For example, in some embodiments, the air permeability of a cushion can be increased by creating openings, orifices and/or other passages or otherwise modifying the cushion body. In some embodiments, a cushion includes a covering material, such as, for example, upholstery, vinyl, leather or the like, that help provide the seat assembly 10B with a soft surface and other functional and aesthetic advantages.

Figure 8A:
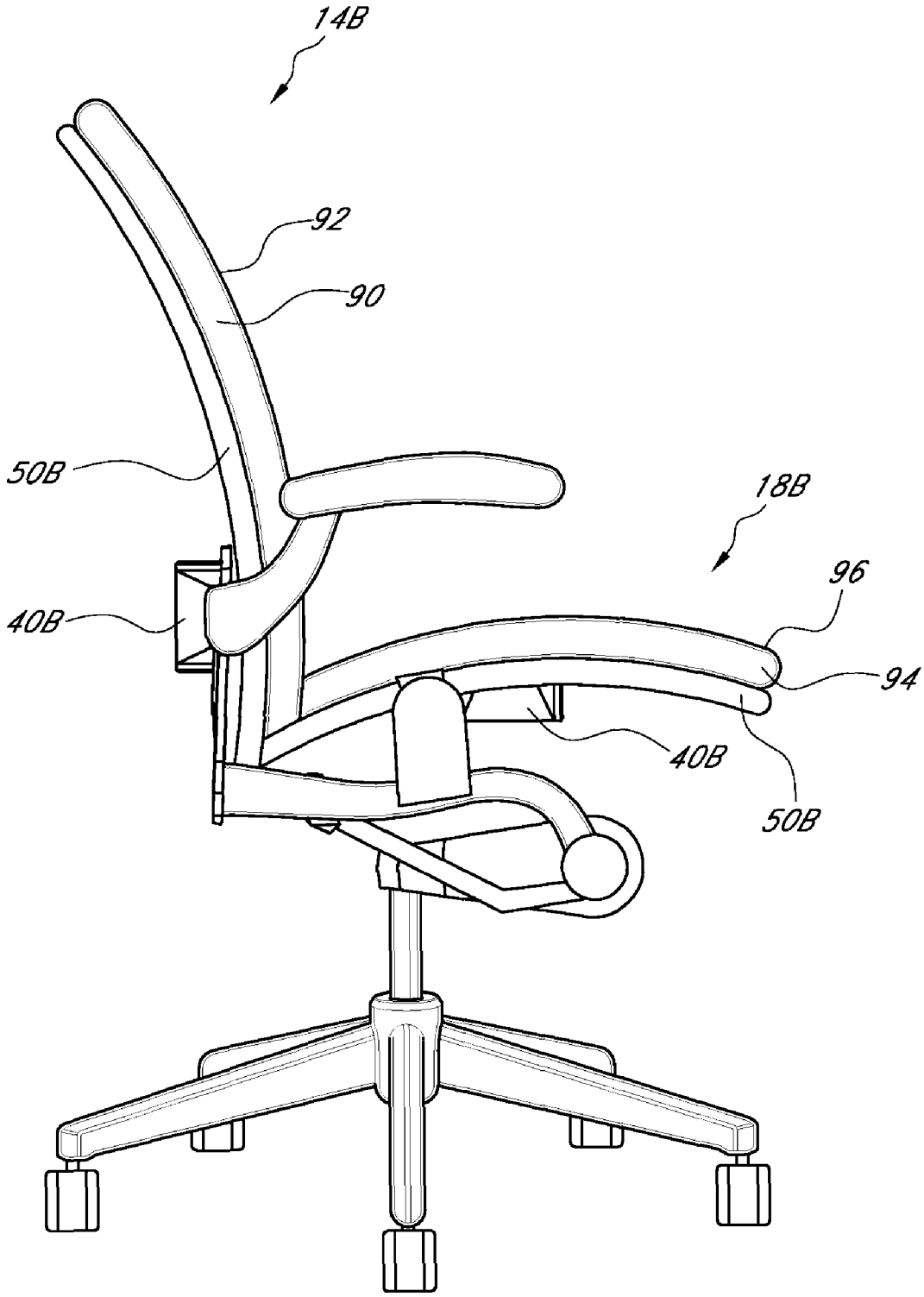
FIG. 8A is a side view of the seating assembly of FIG. 7.

FIG. 8A illustrates a side view of the seat assembly of FIG. 7. As shown, the seat assembly 10B can comprise a single frame structure 50B that supports both the backrest portion 14B and the seat bottom portion 18B. However, in other arrangements, the seat assembly 10B may include two or more frame structures. For example, the backrest portion 14B and the bottom seat portion 18B can each include a separate frame structure.

With continued reference to the embodiment illustrated in FIG. 8A, the backrest portion 14B of the seating assembly includes a cushion 90, the outer surface of which may be covered by one or more covering materials 92. Likewise, the bottom seat portion 18B includes a cushion 94, which may also be upholstered with one or more covering materials 96. In other arrangements, a single, continuous cushion can be used for both the backrest portion 14B and the bottom seat portion 18B. Alternatively, the seat assembly 10B can comprise more or fewer cushions than illustrated in FIG. 8A. For example, the seat assembly 10B can include one or more side cushions in addition to the main backrest cushion 90 and/or bottom seat cushion 94. As will be described below, one or more fluid modules 40B can be attached to the backrest portion 14B and/or the bottom seat portion 18B to provide conditioned and/or unconditioned fluid to targeted areas of the seat assembly 10B.

Figure 8B:
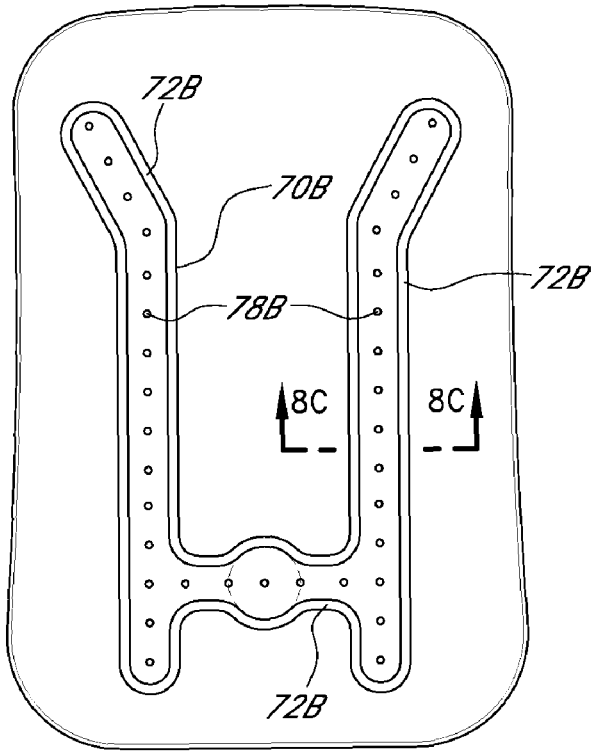
FIG. 8B is a rear view of the backrest portion of the seat assembly of FIG. 7 with a frame structure removed to reveal a rear of the cushion portion.
Figure 8C:
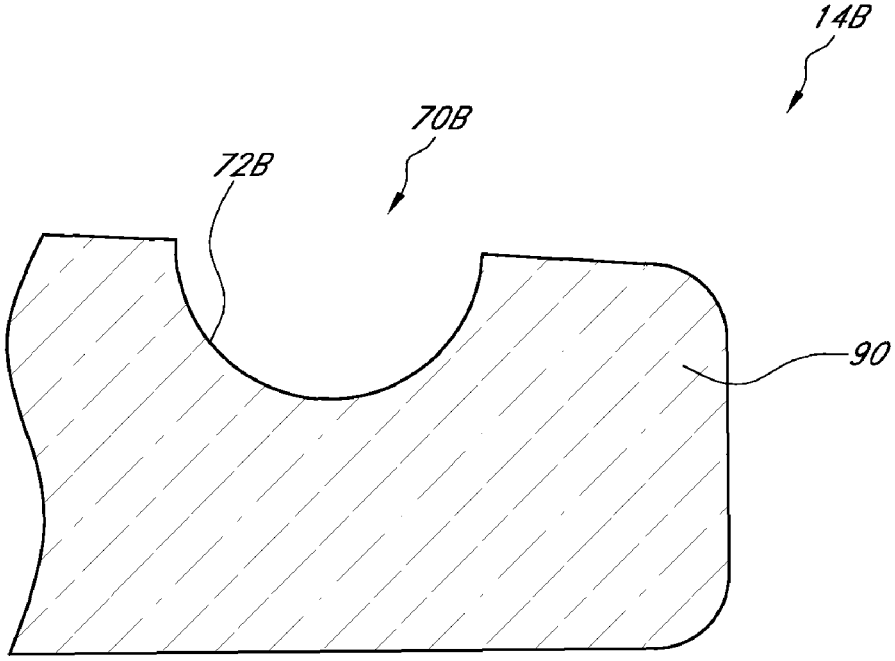
FIG. 8C is a cross sectional view of the backrest portion of FIG. 8B.

FIG. 8B is a rear view of the backrest portion 14B of the seat assembly 10B of FIG. 7. As illustrated, the backrest portion 14B has been separated from the adjacent support frame 50B to expose a distribution system 70B. In one embodiment, as depicted in FIGS. 8B and 8C, the air distribution system 70B is formed directly into the body of the cushion 90. For example, the foam or other material that comprises the cushion can include one or more recessed channels 72B of the distribution system 70B. Alternatively, the channels 72B of the distribution system 70B can be formed after the cushion is manufactured (e.g., by removing cushion material).

In the embodiment illustrated in FIGS. 8B and 8C, the distribution system 70B comprises three main channels 72B, two of which have a generally vertical orientation and a third that has a generally horizontal orientation and hydraulically connects the other two. As with other embodiments discussed herein, the channels 72B can include a generally curvate shape. Further, the channels can comprise a plurality of orifices 78B toward the interior section of the cushion 90 through which air or other fluid can exit. However, it will be appreciated that the shape, size, general configuration and/or other details of the distribution system 70B can vary, as required or desired by a particular application or use. For example, the distribution system 70B can have more or fewer channels than illustrated and discussed herein. In addition, the distribution system 70B can encompass a greater or smaller surface area of the adjacent cushion 90. Further, depending on the desired distribution of airflow through the cushion, the number, size, position, spacing, density and/or other characteristics of the orifices 78B may vary.

In some embodiments, the distribution system 70B is configured so that air is permitted to exit the distribution channels 72B only through the orifices 78B. This can provide increased flow control of fluid passing through the backrest portion 14B. Thus, the channels 72B of the distribution system 70B can be manufactured from one or more materials that are capable of substantially obstructing the flow of air. In some embodiments, a coating, layer or other covering can be included on the inner surface of the channels 72B to ensure that air delivered to the distribution system 70B escapes only through the orifices 78B. In other embodiments, an insert can comprise one or more rigid or semi-rigid materials (e.g., plastic). Such an insert can be sized, shaped and otherwise configured to fit within the channels 72B of the distribution system 70B to minimize or prevent the undesired passage of air through the walls of the channels 72B.

Figure 8D:
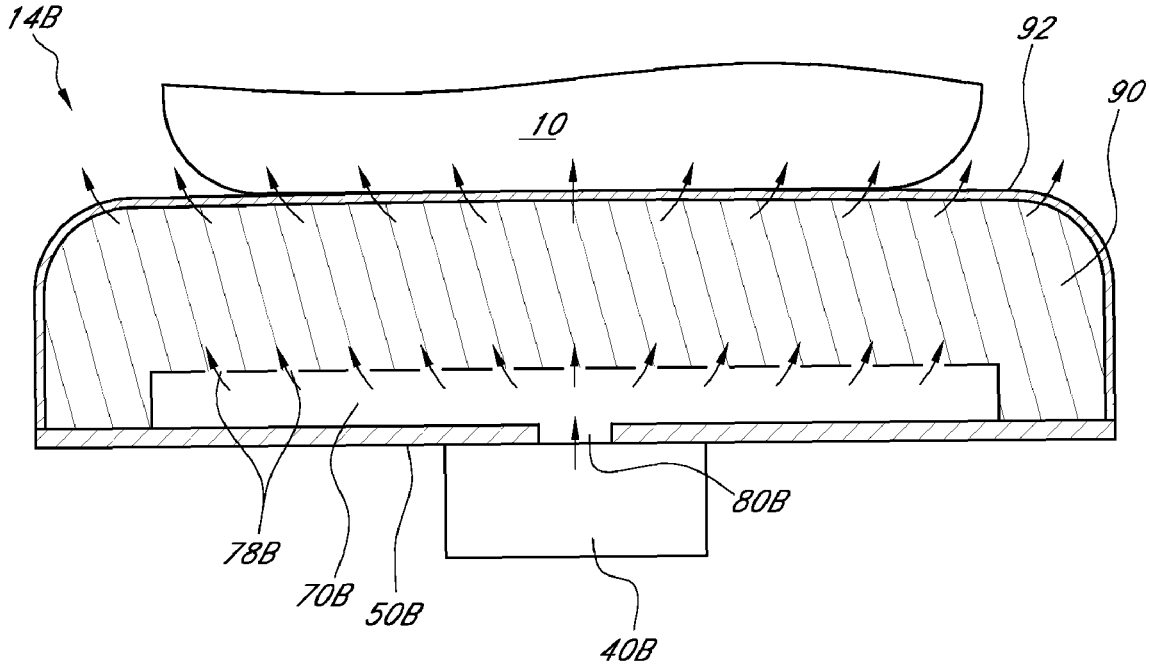
FIG. 8D is a schematic illustrating air flowing through a backrest portion of a chair according to the embodiments depicted in FIGS. 8A-8C.

FIG. 8D schematically illustrates one embodiment of an air flow pattern through the backrest portion 14B of a climate controlled seating assembly. As shown, in order to properly enclose the channels of the distribution system 70B and to create air passages therethrough, the rear of the cushion 90 can be attached to a frame structure 50B or other member. In some arrangements, the frame structure 50B is manufactured from metal, plastic and/or one or more other rigid or semi-rigid materials. A substantially air-tight connection can be provided between the cushion 90 and the frame structure 50B or other similar member to ensure that air directed into the distribution system 70B exits only through the orifices 78B. In FIG. 8D, the fluid module 40B is positioned over an opening 80B in the frame structure 50B. Thus, air from the fluid module 40B may pass through the opening 80B and enter the distribution system 70B. Once in the distribution system 70B, air can be advantageously channeled to the various orifices 78B where it exits toward the interior of the cushion 90.

With continued reference to the embodiment illustrated in FIG. 8D, the cushion 90 and the covering material 92 that surrounds it are preferably constructed of one or more air-permeable materials, allowing the air discharged from the distribution system 70B to diffuse through them. Consequently, air from the fluid module 40B can reach the occupant O of the seat assembly 10B. In other embodiments, to attain the proper balance between structural integrity, comfort, air permeability and one or more other considerations, the cushion 90 includes one, two or more layers of various materials, thicknesses, porosities, shapes and/or other characteristics. For example, a softer, more air permeable layer may be placed along the exterior of the backrest portion 14B, near the occupant. On the other hand, a more rigid, less air permeable cushion layer can be provided at the rear of the backrest portion 14B, near the distribution system 70B. In such an embodiment, it may be necessary to provide channels or other passages through the more rigid cushion layer to permit air exiting the orifices of the distribution system 70B to reach the more air-permeable cushion layer. Those of skill in the art will appreciate that the design of the cushion 90 can be modified to have one or more other configurations, utilizing greater or fewer cushion layers.

Figure 9:
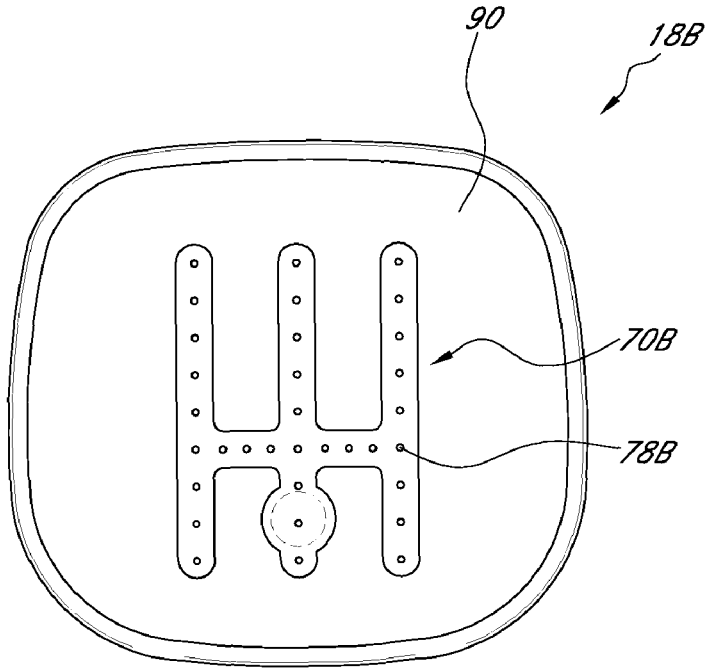
FIG. 9 is a bottom view of one embodiment of a seat bottom portion with a frame structure removed to reveal the bottom of the cushion.

FIG. 9 illustrates a bottom view of the bottom seat portion 18B of the seat assembly 10B of FIG. 7. Similar to the embodiment of FIG. 8B, the depicted bottom seat portion 18B is separated from the adjacent support frame 50B to reveal the adjacent distribution system 70B. As discussed with reference to the backrest portion herein, the air distribution system 70B can be formed directly into the body of the cushion 90. In fact, the same options and embodiments that were discussed in relation to the backrest portion apply equally to the bottom seat portion illustrated in FIG. 9. Thus, a seat assembly can be configured to provide airflow to its backrest portion 14B and/or its bottom seat portion 18B for climate control purposes.

In addition, it will be appreciated that one or more other portions of the seat assembly, such as, for example, side cushions, a footrest, a headrest and the like, can be configured with similar airflow features to further enhance the climate control characteristics of the seat assembly. In some embodiments, the seat assembly 10B can be advantageously equipped and otherwise configured with a controller that permits an occupant to control the flow rate and/or the temperature of the air being transmitted through the various portions of the seat assembly 10B. For example, the controller can include an on/off switch, adjustment knobs and/or other adjustment devices for regulating the flow and/or temperature of fluid delivered to the seat assembly. In addition, the controller can permit a user to select a desired temperature setting along one or more outer surfaces of the seat assembly. In such embodiments, the seating assembly can include one or more thermostats to self-regulate the flow and/or temperature of air being delivered to the seating assembly.

Figure 10A:
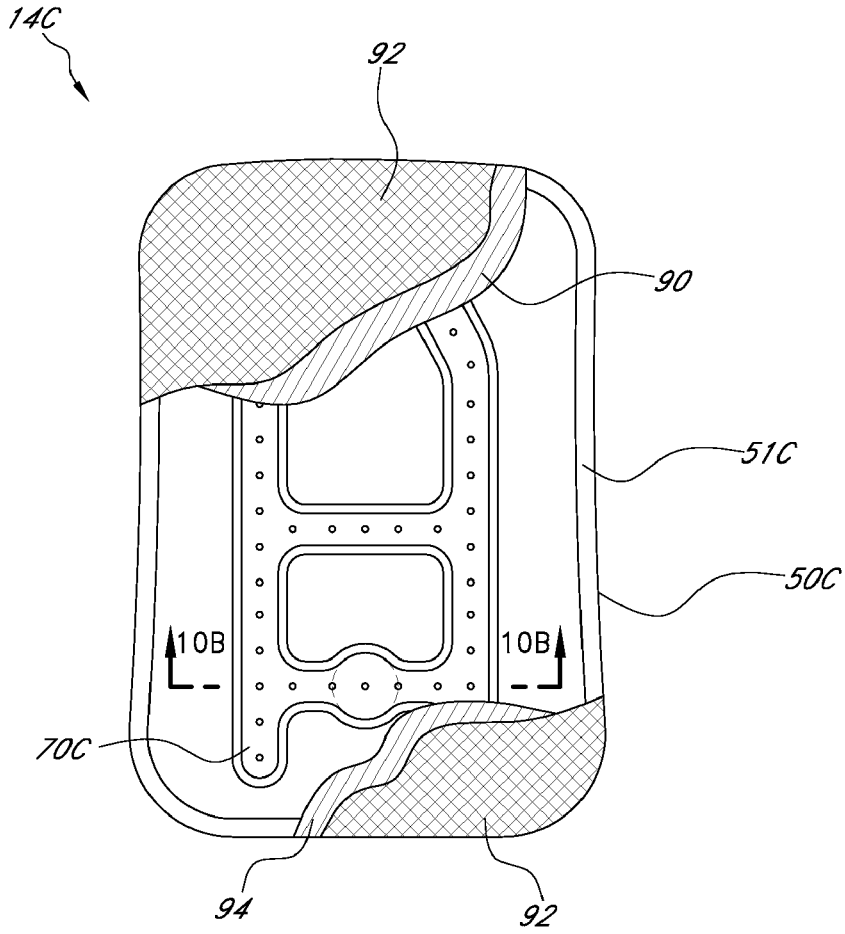
FIG. 10A is a front view of a backrest portion according to one embodiment.

FIG. 10A illustrates a cutaway front view of another embodiment of a backrest portion 14C of a climate control seat assembly. As illustrated, a large portion of the cushion 90 and the covering material 92 have been removed in order to show the underlying air distribution system 70C. In this arrangement, the distribution system 70C is not formed into the body of the cushion 90. Instead, the distribution system 70C is attached directly to the frame structure 50C of the backrest portion 14C. As shown in the cross sectional view of FIG. 10B, the entire distribution system 70C can be situated within a recessed area of the frame structure 50C defined by a peripheral raised flange 51C of the frame structure 50C. The distribution system 70C may be connected to the frame structure 50C using one or more attachment methods or devices, such as, for example, glues or other adhesives, welds, bolts, rivet, snap fittings, other fasteners and/or the like. In other embodiments, the distribution system 70C can be formed directly into the frame structure 50C thereby eliminating the need to separately attach the two members.

Figure 10B:
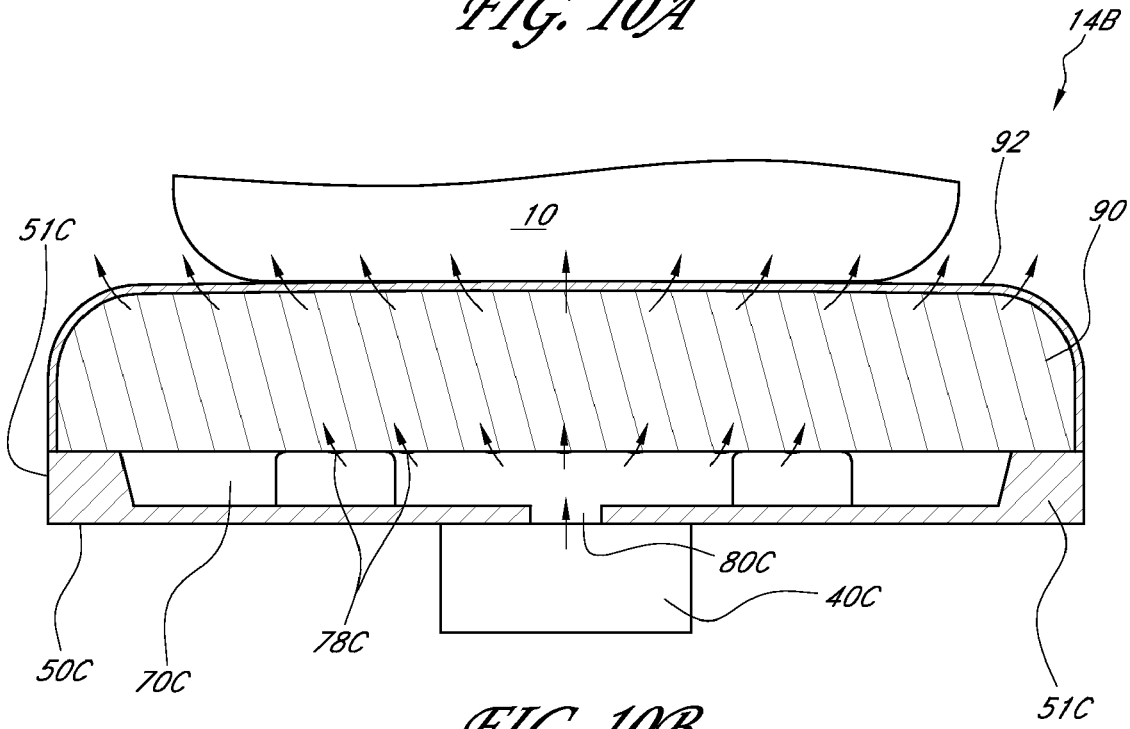
FIG. 10B is a cross sectional view of the backrest portion illustrated in FIG. 10A.

With continued reference to the backrest portion 14B illustrated in FIGS. 10A and 10B, the cushion 90 can be attached to the raised flange 51C of the frame structure 50C. The cushion 90 and covering material 92 can comprise one or more air permeable materials to permit the fluid discharged from the distribution system 70C to be transmitted to the opposite side of the backrest portion 14C, where an occupant O of the seat assembly is generally situated. Like in other arrangements discussed and/or illustrated herein, the frame structure can include an opening 80C to hydraulically connect a fluid module 40C to the underlying distribution system 70C. Air or other fluid can be channeled through the distribution system 70C, can exit through the plurality of orifices 78C and can make its way through the cushion 90 and covering material 92. Those of skill in the art will appreciate that in other embodiments the backrest portion 14C may be configured differently than shown in FIGS. 10A and 10B and discussed herein. For example, the frame structure 50C need not have a raised flange even if the distribution system 70C is directly attached to or formed as part of the frame structure.

Fluid Module in Lumbar Support Member

Figure 11:
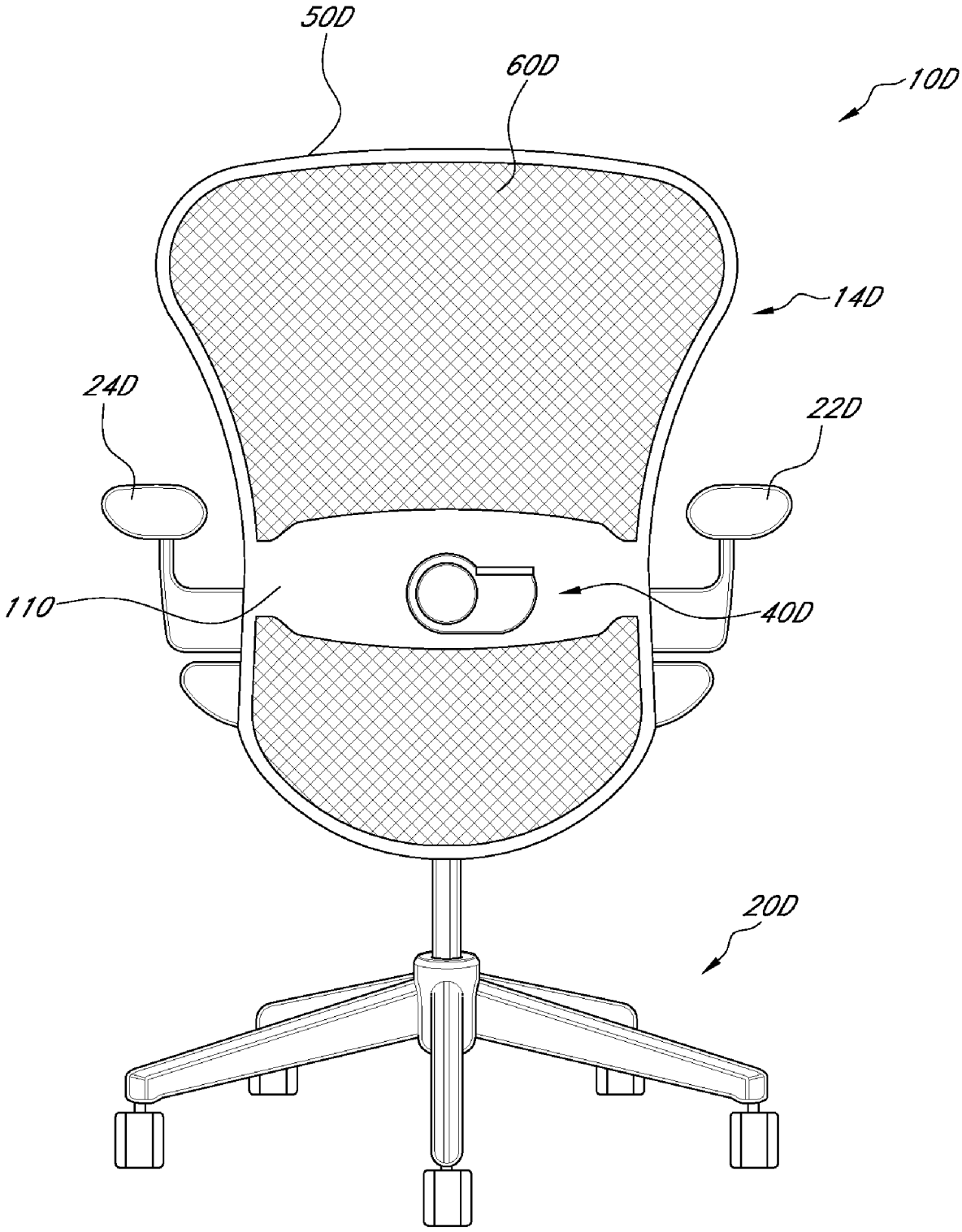
FIG. 11 is a rear view of a seating assembly with the rear panel of the backrest portion removed according to another embodiment.

FIG. 11 illustrates a rear view of a seating assembly 10D according to one embodiment. Like with other seating assemblies discussed and illustrated herein (e.g., FIG. 1), the depicted seating assembly 10D can include one or more mesh fabric surfaces that interface with a seated occupant. In the embodiment of FIG. 11, the backrest portion 14D includes an outer frame structure 50D and a mesh fabric 60D that spans across the frame structure 50D. It will be appreciated that the bottom seat portion (not shown) can also include a similar design. As discussed, the mesh fabric 60D can be advantageously manufactured from one or more flexible layers that are capable of withstanding the loads imposed on it by an occupant.

With continued reference to FIG. 11, the seating assembly 10D can include a horizontally-oriented lumbar support member 110 that generally attaches to opposite sides of the frame structure 50D of the backrest portion 14D. In some embodiments, the backrest portion 14D is configured so that the position of the lumbar support member 110 relative to the frame structure 50D may be easily modified. This enables an occupant to selectively position the lumbar support member 110 in a desired vertical location according to his or her bodily characteristics and/or general preferences. The additional lower back support offered by the lumbar support member 110 can be especially important for backrest portions 14D that utilize a non-rigid, flexible mesh fabric interface with the seat assembly occupant, as this can help to further reinforce and correctly maintain the position of an occupant's lower back.

In some embodiments, climate control features are incorporated directly into the lumbar support member 110. For example, as illustrated in FIG. 11, a fluid module 40D can attach to a rear surface of the lumbar support member 110. As is described in greater herein, the fluid module 40D can be configured to deliver air or other fluids to the backrest portion 14D through one or more distribution systems situated within the lumbar support member 110. The air or other fluid discharged by the fluid modules may be conditioned (e.g., cooled and/or heated) and/or unconditioned (e.g., ambient).

Figure 12:
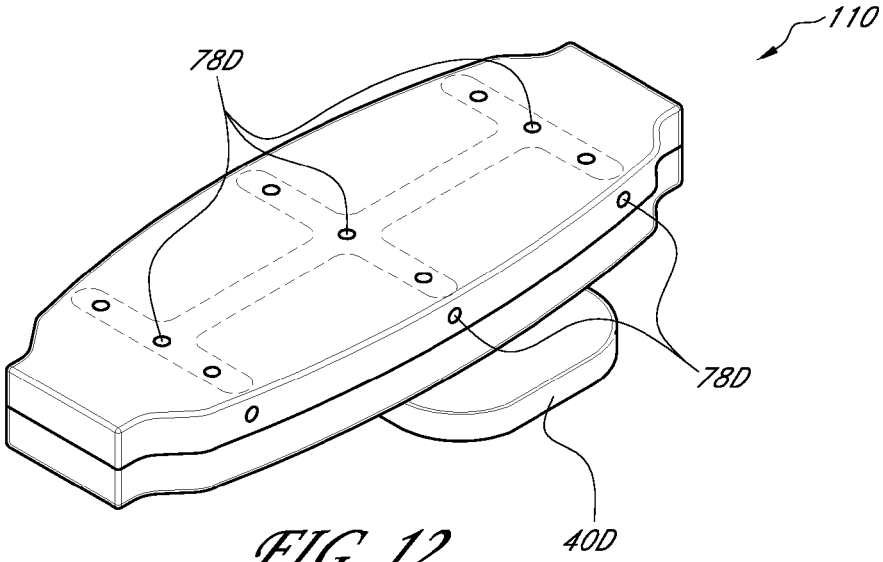
FIG. 12 is a perspective view of one embodiment of a lumbar support member configured for use in a seating assembly such as the one illustrated in FIG. 11.
Figure 13A:
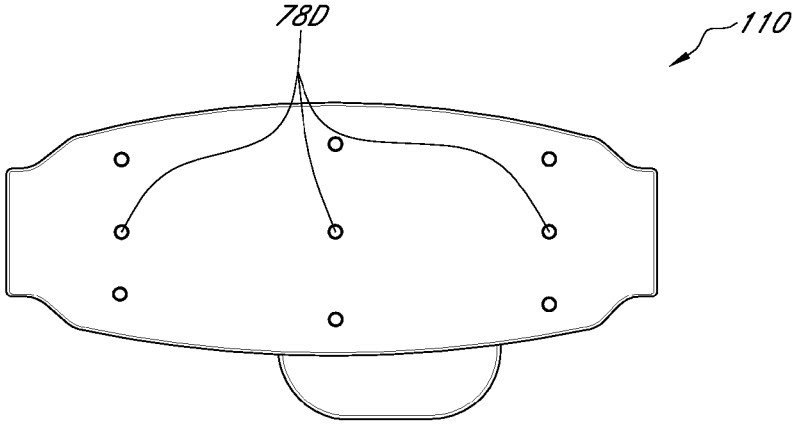
FIG. 13A is a front view of the lumbar support member of FIG. 12.

FIG. 12 illustrates one embodiment of a lumbar support member 110 comprising or equipped with a fluid module 40D similar to the one illustrated in FIG. 11. In order to provide the necessary support, the lumbar support member 110 can comprises one or more rigid and/or semi-rigid materials, such as, for example, metal, plastic, other polymeric substances, other synthetics and/or the like. As depicted in FIGS. 12 and 13A, the lumbar support member 110 can include a plurality of orifices 78D along one or more of its surfaces (e.g., the surface generally opposite of the fluid module 40D). Thus, in some embodiments, the orifices 78D are generally positioned immediately adjacent to the mesh fabric 60D when the lumbar support member 110 is mounted on the backrest portion 14D of the seat assembly 10D (FIG. 11). In addition, the lumbar support member 110 can include one or more orifices 78D along its narrow curvate or otherwise differently-shaped side surface which, in the illustrated embodiments, is substantially perpendicular to the mesh fabric 60 when the support member 110 is secured to the backrest portion 14D.

Figure 13B:
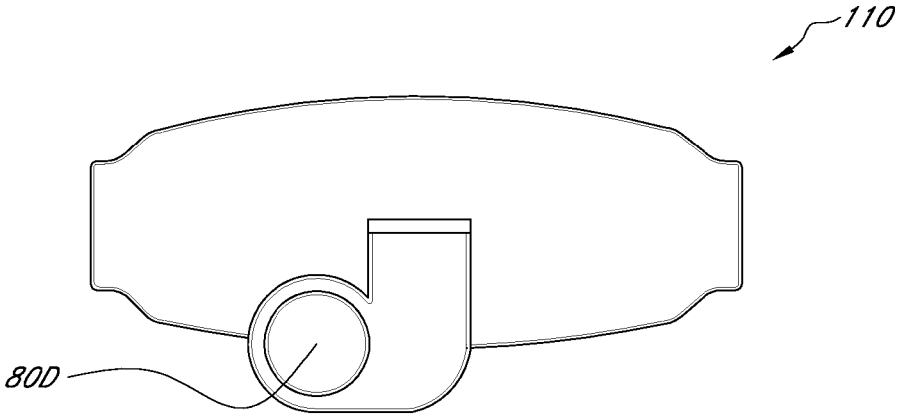
FIG. 13B is a rear view of the lumbar support member of FIG. 12.

FIG. 13B illustrates one embodiment of a rear surface of the lumbar support member 110 to which the fluid module 40D can attach. As shown, such a side or surface of the lumbar support member 110 can include an opening 80D over which a fluid module (not shown) may be positioned. The opening 80D can be configured to permit a fluid module 40D to be in fluid communication with the fluid distribution system of the lumbar support member 110.

Figure 14A:
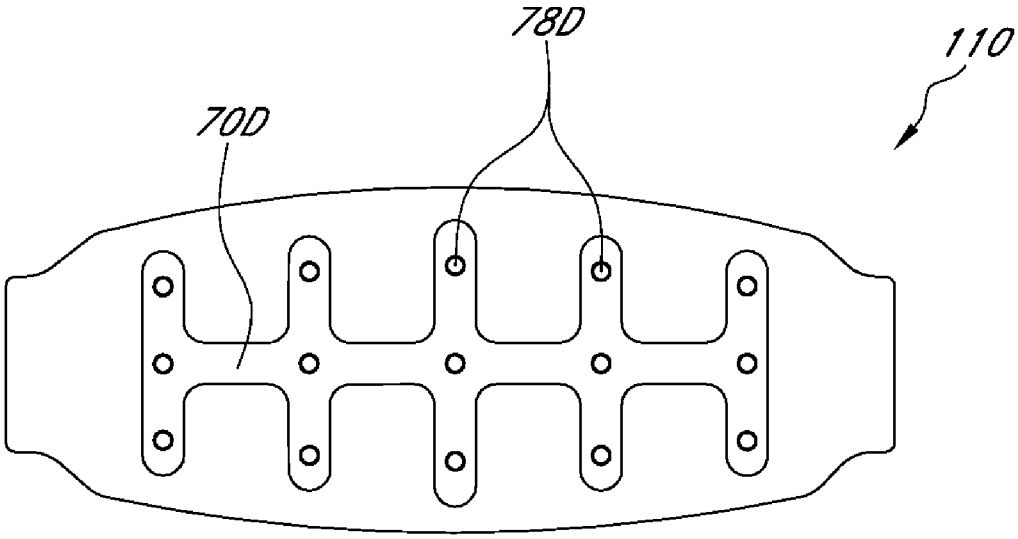
FIG. 14A is a cross sectional view of the lumbar support member of FIG. 12 illustrating an interior fluid distribution system according to one embodiment.

FIG. 14A illustrates one embodiment of the interior of the lumbar support member 110. As shown, the lumbar support member 110 can include a distribution system 70D that is adapted to channel or otherwise convey air or other fluid through defined passageways. Accordingly, air or other fluid can exit the distribution system 70D through the plurality of orifices positioned distributed along the channels of the distribution system 70D. In the illustrated embodiment, these are the same orifices 78D that are visible on the outer surface of the lumbar support member 110 shown in FIGS. 12 and 13A. The illustrated distribution system 70D can extend to the edges of the lumbar support member 110, allowing air to be directed to the side orifices 78D shown in FIG. 12.

Figure 14B:
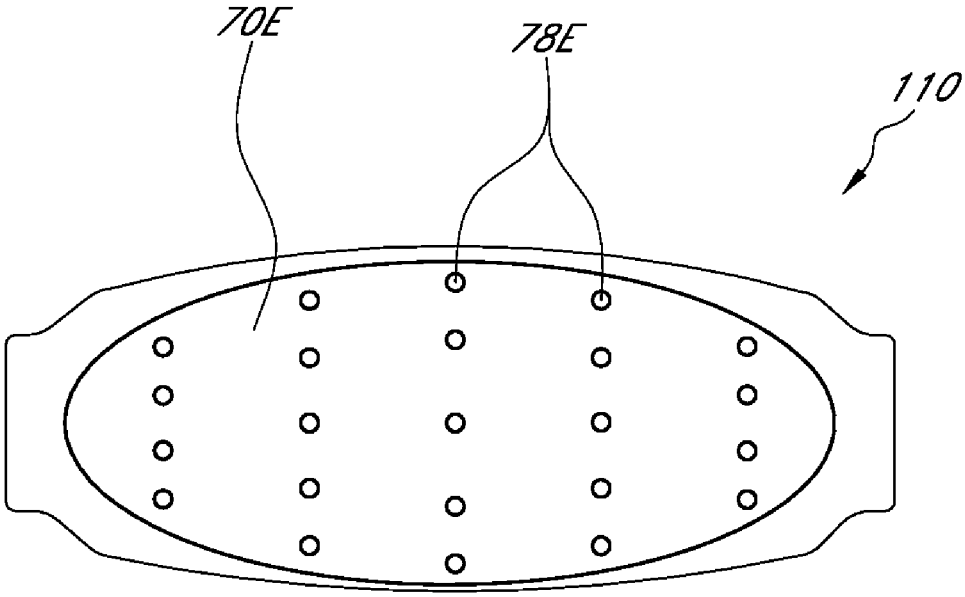
FIG. 14B is a cross sectional view of a lumbar support member illustrating an interior fluid distribution system according to another embodiment.

However, as discussed above in relation to other embodiments, the fluid distribution system 70D of the lumbar support member 110 need not resemble the configuration illustrated in FIG. 14A. For example, the shape, size, orientation and other characteristics of the channels of the distribution system can vary as desired or required by a particular user or application. Further, the quantity, size, shape, location, spacing, density and/or other characteristics of the orifices may also vary. For instance, as illustrated in FIG. 14B, the distribution system 70E need not include individual channels through which air or other fluid is directed. Instead, the depicted distribution system 70E comprises a single cavity having a generally circular shape. Like in other embodiments, air or other fluid can be discharged from such a distribution system 70E toward the backrest portion via a plurality of orifices 78E.

Figure 15:
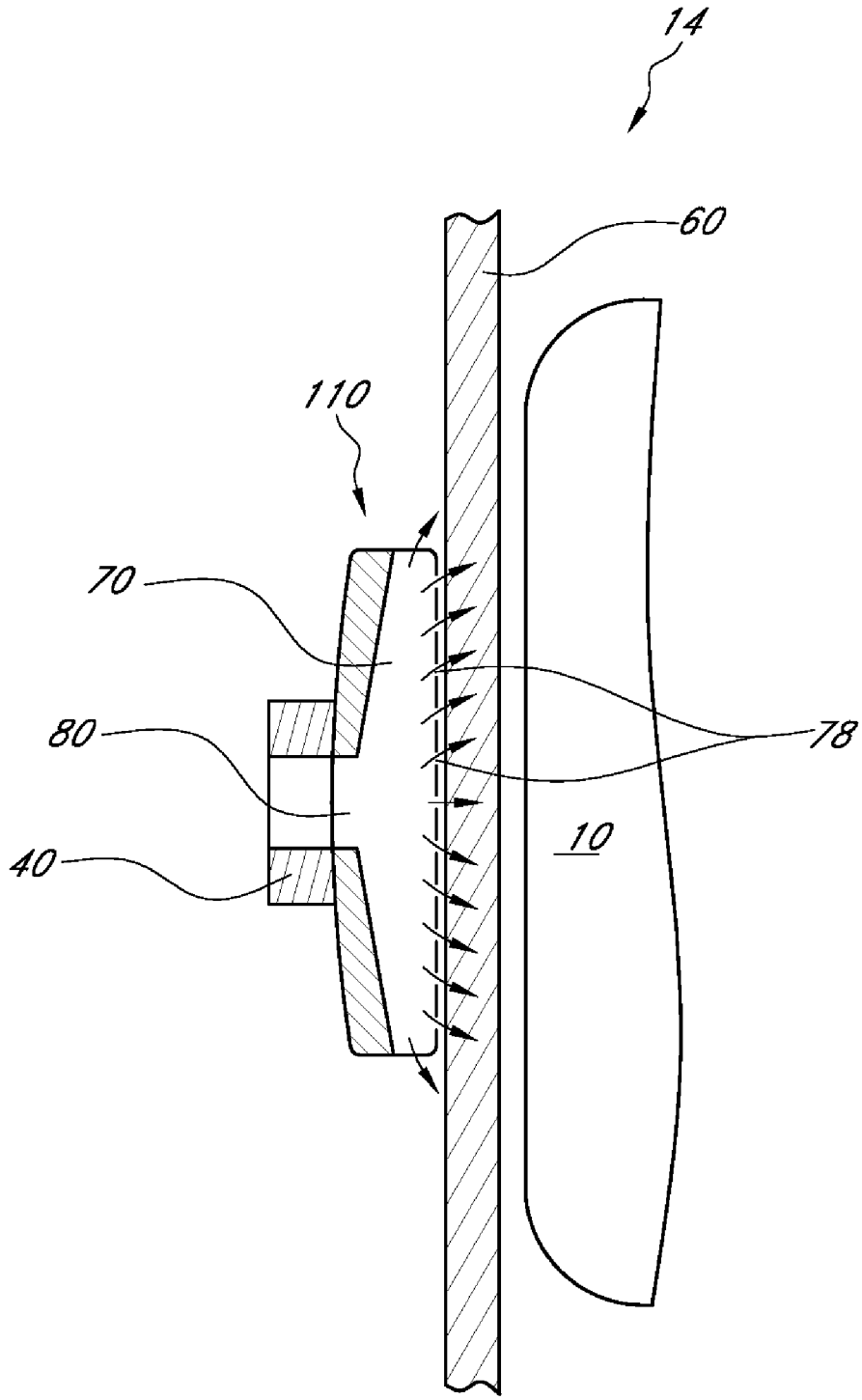
FIG. 15 is a schematic illustrating one embodiment of an air flow distribution pattern through a lumbar support member similar to the ones depicted in FIGS. 12-14.

FIG. 15 schematically illustrates one embodiment of an airflow pattern through a lumbar support member. As shown, a fluid module 40, which can be positioned over an opening 80 on the outer surface of the lumbar support member 110, can be placed in fluid communication with the distribution system 70 located within the interior of the support member 110. Once air is delivered into the distribution system 70, it may be channeled to a plurality of orifices 78 distributed throughout the system 70. Air exiting the orifices 78 can diffuse through the mesh fabric 60 of the backrest portion 14 (and/or other air permeable layers or materials of the seating assembly) to ultimately reach an occupant O positioned on or adjacent to the seating assembly. Consequently, air from a fluid module can be directed to the opposite surface of a cushion-less backrest portion without the need for a rear panel as described above with reference to FIGS. 1-5B. Therefore, the seat assembly can be capable to maintain the "open" look resulting from the use of the mesh fabric.

In one, some or all of the embodiments described and illustrated herein, a climate controlled seating assembly can comprise a fluid module that includes a thermoelectric device for temperature conditioning (e.g., selectively heating or cooling) the air or other fluid flowing through the fluid module. A preferred thermoelectric device is a Peltier thermoelectric module, which is well known in the art. In addition, a fluid module may also include a main heat exchanger for transferring or removing thermal energy from the air or other fluid flowing from the module and to the one or more distribution systems in the seating assembly. The fluid module can also include a secondary heat exchanger that extends from the thermoelectric device generally opposite the main heat exchanger. A pumping device can be included with each fluid module for directing fluid over the main and/or waste heat exchangers. The pumping device can comprise an electrical fan or blower, such as, for example, an axial blower and/or radial fan. In one embodiment, a single pumping device can be used for both the main and waste heat exchanges. However, it is anticipated that separate pumping devices may be associated with the secondary and heat exchangers. Alternatively, the fluid module may be configured to simply deliver ambient air to the seating assembly.

It should be appreciated that the fluid module described above represents only one exemplary embodiment of a device that may be used to condition the air supplied to a distribution system. Any of a variety of differently configured fluid modules may be used to provide conditioned air. Other examples of fluid modules that may be used are described in U.S. Pat. Nos. 6,223,539, 6,119,463, 5,524,439 and/or 5,626,021, all of which are hereby incorporated by reference in their entirety. Another example of such a fluid module is currently sold under the trademark Micro-Thermal Module™ by Amerigon, Inc. In other arrangements, the fluid module may comprise a pump device without a thermoelectric device for thermally conditioning the air. In such an embodiment, the pumping device may be used to remove or supply air to the one or more distribution systems of a seating assembly.

In some embodiments, a heating pad can be incorporated into the backrest portion, bottom seat portion and/or other components or portions of the seating assembly to further enhance the temperature control features of the seating assembly. The heating pad can be included at or near the outer surface of the seating assembly (or any other portion of the seating assembly) to help enhance its effect on the occupant. However, it is anticipated that in some arrangements, one or more heating pads may be included further away from the outer surface of the seating assembly. Alternatively, other heating members (e.g., coils, conductive elements and the like) can be used to provide the seating assembly with additional temperature control capabilities. In some embodiments, such heating pads or similar heating members can be used to simplify the overall design of the fluid modules and the accompanying system (e.g., by eliminating the need to provide both cooling and heating air). As discussed below, the heating pad, along with the fluid modules and other system components, can be powered by one or more battery units mounted on the seat assembly and/or a corded connection to an AC power source (e.g., wall outlet). Further, the operational settings of the one or more heating pads included in a seat assembly are preferably controlled by a central control unit.

Figure 16:
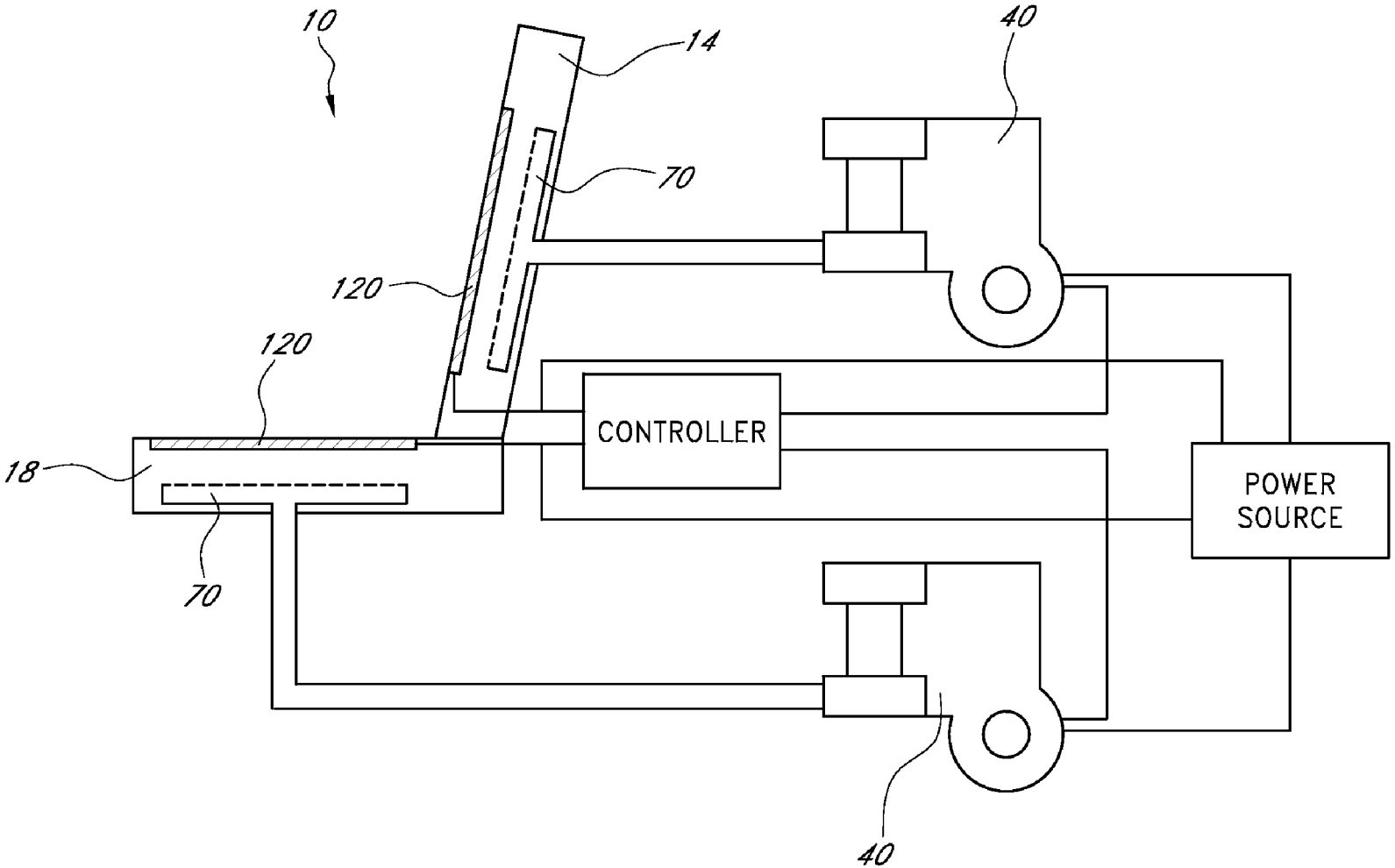
FIG. 16 is a schematic illustrating a climate controlled seating assembly equipped with two fluid modules.

FIG. 16 schematically illustrates a climate controlled seat assembly 10 according to an exemplary embodiment. In this embodiment, both the backrest portion 14 and the bottom seat portion 18 include a fluid distribution system 70. Each distribution system 70 is in fluid communication with its own fluid module 40. However, those of skill in the art will appreciate that a single fluid module may be used to supply air or other fluid to both the backrest portion 14 and the bottom seat portion 18. The fluid modules 40 are connected to an electrical power source (e.g., battery, power cord for AC connection, etc.) and a controller. In addition, the backrest portion 14 and/or the bottom seat portion 18 can optionally include a heating pad 120 or other similar heating member. Preferably, the one or more heating pads 120 are powered by the same power source and controlled by the same controller as the fluid modules 40.

It will be appreciated that the one or more electrically powered components of the different embodiments of the seating assembly disclosed and illustrated herein (e.g., the fluid module, thermoelectric device, heating pads or other heating members, etc.) can be powered by any combination of AC, DC, battery or any other power source. For example, in some embodiments, the climate controlled seating assembly includes a power cord which is configured to plug into an AC power outlet. In other embodiments, the climate controlled seating assembly includes a rechargeable battery, a disposable battery and/or some other power pack. In one embodiment, the rechargeable battery can be configured to be recharged using an AC power source (e.g., the climate controlled seat can include a power cord for recharging the battery when the seating assembly is not in use). In other embodiments, the seating assembly can be powered by one or more other power sources, such as, for example, solar panels, conversion of mechanical movement of the chair to electric power and/or the like.

In operation, fluid in the form of air can be delivered from a fluid module, to one or more fluid distribution systems. As discussed, air or other fluid can flow through the passages created by the channels of the distribution systems of the seating assembly and eventually be directed through one or more orifices in the distribution systems. Then, depending on the particular embodiment involved, air or other fluid can pass through a mesh fabric or similar air permeable material on which an occupant is directly situated, through an air-permeable cushion and covering material and/or the like. In this manner, conditioned and/or unconditioned air can be provided to a front surface of a seat assembly's backrest portion and/or bottom seat portion.

Alternatively, the fluid modules can be configured to generate a suction force, thereby drawing air or other fluid away from the outer surfaces of the seating assembly. For example, air can be drawn through the mesh fabric, covering material and/or cushion'into the orifices of a distribution system. The collected air then can flow through the distribution channels and be expelled out the fluid modules.

In some arrangements intended for outdoor applications, the various components of the seating assembly, including, for example, the frame, base, backrest portion, bottom seat portion, controller, power supply, wiring and the like, and all materials used in the construction of such components, are weather-proofed. Preferably, these components and materials are capable of withstanding the presence of water, moisture, temperature fluctuations, dirt and the like.

Further, as discussed, the embodiments disclosed and illustrated herein can be modified for use in one or more other types of seating assemblies. For example, the features and details disclosed herein can be applied to chemotherapy chairs, dentist chairs, other medical treatment chairs, other medically-related chairs, hospital and other beds and/or any other seating assembly on which occupants tend to be situated for relatively extended time periods. Therefore, one or more other portions of a seating assembly can be modified using the principles and features described herein to deliver air or other fluid to one or more areas of the corresponding seating assembly.

To assist in the description of the disclosed embodiments, words such as upward, upper, bottom, downward, lower, rear, front, vertical, horizontal, upstream, downstream have been used above to describe different embodiments and/or the accompanying figures. It will be appreciated, however, that the different embodiments, whether illustrated or not, can be located and oriented in a variety of desired positions.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A climate controlled seating assembly comprising:

a front side and a rear side, said front side of the seating assembly being generally adjacent to a seated occupant;

at least one covering material located along the front side of the climate controlled seating assembly, said at least one covering material being generally air-permeable and being configured to contact a seated occupant;

a back panel located at and at least partially extending along the rear side of the seating assembly and comprising a first surface and a second surface, said first surface of the back panel facing in toward the front side of the seat assembly, and said second surface of the back panel facing toward the rear side of the seat assembly;

at least one air distribution member positioned along the first surface of the back panel, said at least one air distribution member comprising a plurality of orifices;

wherein the at least one air distribution member and the back panel define at least one air distribution channel therebetween; and at least one inlet through the back panel, said at least one inlet configured to receive air from a fluid module, said at least one inlet being in fluid communication with the at least one air distribution channel;

wherein fluid delivered to the at least one air distribution member from the at least one inlet is generally distributed within the at least one air distribution channel through the plurality of orifices and through the at least one covering material, toward one or more targeted areas of a seated occupant.

2. The seating assembly of claim 1, wherein the seating assembly comprises a vehicle seat having a seat bottom portion and a seat back portion, wherein the back panel is located along at least one of a bottom of the seat bottom portion and a rear of the seat back portion.

3. The seating assembly of claim 1, wherein the seating assembly comprises a bed.

4. The seating assembly of claim 1, wherein the seating assembly comprises a cushion, said cushion being positioned generally between the back panel and the at least one covering material.

5. The seating assembly of claim 4, wherein the cushion is generally air permeable to permit air exiting the plurality of orifices of the at least one air distribution member to pass through said cushion, toward and through the at least one covering material.

6. The seating assembly of claim 4, wherein the cushion member comprises, at least in part, a foam material.

7. The seating assembly of claim 1, wherein the seating assembly is cushion-less, so that an interior cavity extends, at least in part, between the back panel and the at least one covering material.

8. The seating assembly of claim 7, wherein the at least one covering material comprises a mesh structure configured to support a seated occupant thereagainst.

9. The seating assembly of claim 1, wherein the at least one air distribution member and the back panel form a unitary structure.

10. The seating assembly of claim 1, wherein the at least one air distribution member and the back panel are separate items that are coupled to each other.

11. The seating assembly of claim 1, further comprising a fluid module configured to selectively deliver air through the at least one inlet to the at least one air distribution channel.

12. The seating assembly of claim 11, wherein the fluid module is configured to heat or cool air being transferred to the at least one air distribution channel.

13. The seating assembly of claim 1, further comprising at least one battery to provide power to at least one electrical component of the seating assembly.

14. The seating assembly of claim 13, wherein the at least one battery is rechargeable or disposable.

15. The seating assembly of claim 1, further comprising a heating pad or other conductive heating member near the at least one covering material to further enhance the temperature control features of the seating assembly.

16. The seating assembly of claim 1, further comprising an outer frame positioned, at least in part, along a perimeter of the back panel, said outer frame comprising at least one exit opening and an interior fluid passage, wherein air delivered into the interior fluid passage of the outer frame can pass through the at least one exit opening, toward a seated occupant.

17. A climate controlled seating assembly comprising:

a seat bottom portion;

a seat back portion comprising a front side and a rear side, said front side being generally adjacent to an occupant seated on said seating assembly, and said rear side being generally opposite of said front side;

a covering material generally positioned along the front side of the seat back portion, said covering material being generally air permeable;

wherein the covering material comprises a front surface configured to contact and support a seated occupant;

at least one fluid distribution member located along the rear side of the seat back portion, said at least one fluid distribution member comprising a passageway through which air is selectively passed;

wherein the at least one fluid distribution member comprises a plurality of orifices;

said orifices being in fluid communication with the passageway of the at least one fluid distribution member; and a fluid module configured to selectively deliver air to the at least one fluid distribution channel;

wherein the plurality of orifices of the at least one fluid distribution channel are oriented such that air delivered by the fluid module through the passageway and the plurality of orifices generally exits through the covering material and toward one or more targeted areas along the front side of the seat back portion, in the direction of an occupant seated on the seating assembly.

18. The seating assembly of claim 17, wherein the seating assembly comprises a cushion, said cushion being positioned generally between the at least one fluid distribution member and the at least one covering material.

19. The seating assembly of claim 17, wherein the seating assembly is cushion-less, so that an interior cavity extends between the at least one fluid distribution member and the at least one covering material.

20. A climate controlled seat comprising:

an outer frame positioned at least in part along an outer perimeter of a backrest portion or a seat bottom portion of the seat;

at least one covering material at least partially spanning across at least a portion of the outer frame, said at least one covering material being air-permeable;

wherein the at least one covering material is configured to contact and support an occupant seated on the seat;

wherein the outer frame comprises an interior fluid passage and at least one exit opening; and a fluid module configured to selectively deliver air to the interior fluid passage of the outer frame;

wherein air delivered into the interior fluid passage of the outer frame is configured to pass through the at least one exit opening of the outer frame and through the at least one covering material, toward a seated occupant.

21. The seating assembly of claim 1, wherein the seating assembly comprises an office chair, wherein the back panel comprises a horizontally-oriented member extending along a lumbar portion of a seat back portion of the seating assembly, and wherein the at least one covering material comprises a mesh fabric.

22. The seating assembly of claim 21, further comprising an outer frame positioned, at least in part, along a perimeter of the seat back portion, wherein the back panel extends generally horizontally across a width of the seating assembly and is generally supported by the outer frame.

* * * * *